US008943760B2

(12) United States Patent
Okuda

(10) Patent No.: US 8,943,760 B2
(45) Date of Patent: Feb. 3, 2015

(54) MODULAR SHELTER

(75) Inventor: Shinya Okuda, Singapore (SG)

(73) Assignee: National University of Singapore, Singapore (SG)

( * ) Notice: Subject to any disclaimer, the term of this patent is extended or adjusted under 35 U.S.C. 154(b) by 160 days.

(21) Appl. No.: 13/575,754

(22) PCT Filed: Jan. 28, 2011

(86) PCT No.: PCT/SG2011/000043

§ 371 (c)(1),
(2), (4) Date: Jul. 27, 2012

(87) PCT Pub. No.: WO2011/093801

PCT Pub. Date: Aug. 4, 2011

(65) Prior Publication Data

US 2012/0318314 A1 Dec. 20, 2012

Related U.S. Application Data

(60) Provisional application No. 61/299,502, filed on Jan. 29, 2010.

(51) Int. Cl.

| | |
|---|---|
| ***E04B 1/32*** | (2006.01) |
| ***E04H 15/34*** | (2006.01) |
| ***E04H 1/12*** | (2006.01) |
| *E04B 1/343* | (2006.01) |

(52) U.S. Cl.

CPC ..... *E04H 1/1205* (2013.01); *E04B 1/34321* (2013.01); *E04B 2001/3282* (2013.01)

USPC ..... 52/81.2; 52/79.3; 52/745.03; 135/123; 135/124; 135/159

(58) Field of Classification Search

CPC ..... E04B 7/10; E04B 7/102; E04B 1/32; E04B 1/34321; E04B 2001/3276; E04B 2001/3282; E04H 1/02; E04H 1/12; E04H 1/1205; Y10S 52/15

USPC ..... 135/87, 95, 97, 121, 122, 135–138, 135/157–160, 905, 906, 909, 123; 52/80.1, 52/80.2, 81.4, 81.5, 82, 86, 79.3, 79.4, 52/791.1–792.1, 792.11, 81.1–81.3, 52/745.03, 749.19; 446/102, 106, 108, 446/111, 117, 122, 124–125, 127

See application file for complete search history.

(56) References Cited

U.S. PATENT DOCUMENTS

| | | | | | |
|---|---|---|---|---|---|
| 2,933,056 | A | * | 4/1960 | Martin | 52/86 |
| 3,349,525 | A | * | 10/1967 | Payne | 52/81.5 |
| 3,675,380 | A | * | 7/1972 | Moss | 52/81.4 |
| 3,763,608 | A | | 10/1973 | Chamlee | |
| 4,009,543 | A | * | 3/1977 | Smrt | 52/81.2 |
| 4,665,664 | A | * | 5/1987 | Knight | 52/81.5 |
| 5,715,854 | A | | 2/1998 | Andrieux et al. | |

(Continued)

*Primary Examiner* — Winnie Yip

(74) *Attorney, Agent, or Firm* — Westerman, Hattori, Daniels & Adrian, LLP

(57) ABSTRACT

The modular shelter related to temporary building for keeping goods or people. The modular shelter utilizes some standardized shells for constructing walls of the modular shelter. Each of the shells can have sidewalls or ribs for strengthening the shells' curvature and strength. These standardized shells can further be stacked such that they become compact for storage and transportation. Multiple number of the modular shelter can also be joined together for providing extended shelters.

29 Claims, 20 Drawing Sheets

(56) References Cited

U.S. PATENT DOCUMENTS

| | | | | |
|---|---|---|---|---|
| 5,833,512 | A * | 11/1998 | Nicola | 446/114 |
| 5,941,041 | A * | 8/1999 | Robinson et al. | 52/591.4 |
| 6,282,849 | B1 * | 9/2001 | Tuczek | 52/81.1 |
| 6,408,576 | B1 * | 6/2002 | Roth | 52/85 |
| 6,421,963 | B1 * | 7/2002 | Pratola | 52/81.1 |
| 6,499,260 | B2 * | 12/2002 | Kasinger et al. | 52/79.4 |
| 7,237,363 | B2 * | 7/2007 | Wilson | 52/80.1 |
| 7,458,186 | B2 | 12/2008 | Carter | |
| 2012/0247693 | A1 * | 10/2012 | Hill | 160/368.1 |

* cited by examiner

MODULAR SHELTER

CROSS-REFERENCE TO RELATED APPLICATIONS

The present patent application is a nationalization of International application No. PCT/SG2011/000043, filed Jan. 28, 2011, published in English, which is based on, and claims priority from, U.S. Provisional Application No. 61/299,502, filed Jan. 29, 2010, both of which are incorporated herein by reference in their entireties.

The present application relates to a modular shelter for providing temporary accommodation to humans, animals or goods. The present application also relates to a method for making the modular shelter. The present application further relates to methods of storing, transporting, assembling, using and disposing the modular shelter.

Tensile structure, frame-panel structure and surface-active structure are three basic structural types found in temporal shelters. Tents are forms of the tensile structure, which are usually used by nomads and military personnel due to tents' material efficiency and lightweight benefit. Containerized housing units are forms of the frame-panel structure, which are more commonly adopted for contemporary livings because of the containerized housing units' advantage on space efficiency. In contrast, the surface-active structure, such as those found in thin-shell domes, is less commonly adopted for the temporal shelters, although the surface-active structure is both material and space efficient.

Due to increasing shortage of natural resources for producing building materials (e.g. steel) in recent years, material efficient structures have attracted more attentions for building shelters with low material consumption. However, shelters with the surface-active structure remain unpopular due to typically high labor cost for construction. Hence, the problem of high labor cost has to be solved or at least alleviated before the efficiencies of material and space can be realized in building shelters with the surface-active structure.

The present inventions aim to provide some new and useful devices and methods. Essential features of the present inventions are included in one or more independent claims, whilst preferred features of the present inventions can be found in one or more dependent claims.

According to one aspect of the invention, the present application provides a shell structure. The shell structure includes a first modular shelter that comprises a first curved wall. The first curved wall further comprises a first shell and a second shell. The term "shell" describes a hard thin wall that can be found as a hard covering of an egg, a crustacean, a tortoise or a dome. The first modular shelter may be more conveniently referred as a modular shelter or a shelter.

The first shell comprises a first curved base wall and a first sidewall. The first sidewall extending from a first shell edge of the first curved base wall for upholding or supporting curved shape or curvature of the first curved base wall. The surface of the first sidewall can be discontinuous from that of the first curved base wall such that the first sidewall and the first curved base wall form a ridge, a line or an edge at their joints. For example, the first sidewall can be substantially perpendicular to the first curved base wall at the edge of the first curved base wall for providing an effective support to maintain the curvature of the first curved base wall.

The second shell comprises a second curved base wall and a second sidewall. The second sidewall extends from a second shell edge of the second curved base wall for supporting or upholding curved shape or curvature of the second curved base wall.

Moreover, the first sidewall and the second side wall face each other at their principal faces and are neighboring each other. A principal surface of a wall is often known as the broadest area of the wall, whilst a cross-section of the wall is typically a narrow strip. The principal faces of the first sidewall and the second sidewall are connected either directly or indirectly (e.g. via a fastener) such that the first sidewall and the second sidewall are united together in forming a rib of the first curved wall for providing mutual support or alignment between the first shell and the second shell. The first sidewall and the second sidewall can be alternatively connected to each other via a third piece, such as a rubber sheet between the two sidewalls. Alternatively, the first sidewall and the second sidewall can be connected to each other contiguously such that friction support exists between the first sidewall and the second sidewall. The two shells are connected together by the rib for supporting and providing structural continuity to the first curved wall.

The modular shelter provides a material efficient temporary housing structure. Since the shells of the modular shelter are self-supporting for sustaining extended areas, the modular shelter avoids bars for pulling edges or corners of the shells for covering an area, in contrast to the tents.

Although a single curved shell, such as the curved base wall, can be weak in supporting its shape or maintaining structural integrity of its curvature, the first shell also has the first sidewall that is joined to the first curved base wall at the first shell edge. The first sidewall and the first curved base form a pocket, a receptacle or a chamber such that rigidity of the first curved base wall is enhanced.

Moreover, when the principal faces of the first sidewall and the second sidewall are directed towards each other and further joined together, the two sidewalls hold each other, not only preventing relative movements between them, but also stopping warp of the curved base walls.

The curved base walls whose principal faces are curved enable the shells to be thin. A flat sheet of shell material, as compared to the curved base wall, requires a thicker sheet material to withstand the same amount external pressure on its principal face. Hence, the modular shelter with the first curved wall can be lighter and consume less material for building the curved wall.

The first sidewall provides a boundary of the first curved base wall. Especially, since the first sidewall tends to bend towards a concave area of the first curved base wall under an uniform pressure on its convex principal surface/area, the first sidewall can be increased in rigidity for a curvature of the first curved base wall. The first shell is thus made more robust, which permits a thinner wall to form the first curved base wall.

Since the first sidewall and the second sidewall are connected to each other, either by contacting each other directly or via a mutual joint structure (e.g. rubber strip), they become unitary and provide mutual support. In the connected formation, the first shell and the second shell become a single curved piece that is much stronger than a standalone shell. If the two sidewalls are separately supported by external structure, the two shells will not be able to support each other at the sidewalls and the first curved wall has to become thicker, more bulky and heavier. In short, the modular shelter can be made more robust with thinner shells. The thinner shells will cost less to build and to transport.

The term "modular" indicates that the shelter can be employed as a single unit for constructing a collection of shelters that include many units of the shelter. Typically, the multiple shelters can be connected to each other for occupying less area/space and providing mutual support. However, the "modular" shelter does not preclude building a single modular shelter. For example, the modular shelter can be conveniently used as an exhibition booth for indoor usage. The modular shelter can even be built with only the first curved base wall. For example, the first curved base wall can be affixed to a concrete wall as a ceiling or roof such that the modular shelter can prevent rainfall from reaching goods under the first curved base wall. In practice, the modular shelter can employ one or more curved walls, evening forming a completely sealed closure in a cubical form.

The first modular shelter provides space efficiency and structural adaptability. In the above description, the second shell and its parts can be similar to first shell, such as in function, structure, size or material.

The first sidewall and the first curved base wall may form a first pocket for receiving at least a portion the second shell. Since the first sidewall folds towards a recess area of the first curved base wall, the curvature of the first curved base wall become discontinuous at the first sidewall. In fact, the first sidewall and the first curved base wall form a receptacle for accommodating the second shell of a similar shape. In other words, the first sidewall and the second sidewall can be stacked, which become compact for transportation or storage. A joint between the first sidewall and the first curved base wall does not have to be continuous, although surface continuity of the first curved wall at the rib is more desired by connecting the two sidewalls contiguously. For example, the first sidewall and the first curved base wall can have connections via middle plate for providing a gap between the two shells.

The first shell and the second shell can have similar sizes or shapes such that the second shell is substantially receivable by the first pocket for stacking. When made with similar sizes and shapes, anyone of the first shell and the second shell can be received almost completely by the other. The mutually receivable or stackable shells further reduce complexity for handling. The two shells become much compact when stacked. Stacked shells are convent for storage, transportation and protecting structural integrity of the shells.

Preferably, the first sidewall has a first corrugated region for proving the rib for supporting the first curved wall. The first corrugated region on one or more portions of the first sidewall can further enhance structural strength of the first sidewall and the first curved base wall. More advantageously, the corrugated region is formed on a principal face or a broadest area of the first sidewall such that the first curved base wall can be enhanced in its structural strength, without requiring a thicker sheet material to form the first sidewall.

More desirably, the second sidewall has a second corrugated region for matching with the first corrugated region. Although the second corrugated region can also increase structural rigidity of the second curved base wall, the second corrugated region, when attached to or mated with the first corrugated region, both of the two shells are further improved in their robustness. The attachment between the first sidewall and the second sidewall also prevent relative movements between the two sidewalls such that the first shell and the second shell can be kept steadily with respect to each other for assembling. The corrugation feature may be replaced by another surface matching, such as nipples with dimples, ribs with slots, studs with holes and two opposing roughened surfaces.

The first sidewall can comprise a second gutter. The gutter is a channel, a conduit or a slot for receiving an inserted piece or drawing water. The gutter can be easily formed by bending a sheet material to form a tunnel with a U-shaped cross-section. The gutter can facilitate alignment and water drainage of the modular shelter.

In a preferred form, the second sidewall comprises a second tongue for inserting into the second gutter on the first shell for alignment or water drainage. Since the second tongue and the second gutter on separate parts (i.e. first shell and second shell), after the insertion, the first shell and the second shell are connected together and a gap between the two shells is substantially reduced or sealed off. The first curved wall can thus be made water proof, especially when the shells are made of waterproof materials. Rainwater, which falls onto the two shells, can be guided away from the first curved wall at the second gutter for drainage.

The first curved base wall may comprise a two-directional curvature. Although a one-directional curvature can be sufficient for building the modular shelter, the two-directional curvature of the same shell can have higher strength as compared to that of the one-directional curvature with a same thickness. Having the bi-directional enables the modular shelter to afford thinner shells. An example of the one-directional curvature is a cylindrical surface. An example of the two-directional curvature is a parabolic curvature.

The first curved base wall can comprise hyperbolic paraboloid curvature. The first shell having the hyperbolic paraboloid curvature is especially strong for against uniform pressure on the first shell or the first curved wall. The first shell can be made thinner when the hyperbolic paraboloid curvature is adopted for providing a principal face or area of the first shell. The hyperbolic paraboloid shell can be modularized with various configurations. The higher aspect ratio (i.e. height/length), the more efficient structure becomes, while the less efficient space is provided inversely.

Preferably, the first shell further comprises a first extension wall that extends from another edge of the first shell for joining the first shell to another shell. The first extension wall can either be contiguous or detached from the first sidewall, although a contiguous structure provides better support to the first shell. The first shell whose multiple edges are strengthened and surrounded by the first extension wall and the first sidewall forms a container. Structural integrity of the first shell is thus ensured for constructing the modular shelter. In fact, it is more desirable that all edges of the first curved wall are extended with sidewalls. These sidewalls are further preferred to be connected to each other such that all sides/walls of the first shell are mutually supported in forming a pocket either at a concave side or convex side of the first curved base wall. Any of these extended sides/walls may be substantially perpendicular to their respective extending edges of the first curved base wall for an optimized support.

In a preferred embodiment, the first extension wall comprises a corrugated region. The corrugated region, which can have uneven surfaces similar to that on the first sidewall, facilitates assembling the first shell with another shell, in addition to the second shell. For example, the first corrugated extension allows a portion the other shell to be laid on top of the first corrugated extension. The other shell can be a roof or ceiling of the modular shelter whilst the first shell and the second shell can form a first curved wall of the modular shelter. The other shell, the first shell and the second shell can have similar or same shapes and size. In other words, the first extension wall enables the modular shelter to have multiple walls for forming an enclosure, whether the multiple walls are curved.

In another preferred embodiment, the first sidewall, the first curved base wall and the first extension wall form the pocket for receiving the second shell. The pocket, also known as a receptacle, permits that the two shells are stackable for being compact. The first sidewall, the first curved base wall and the first extension wall can be contiguously connected to each other sequentially.

In a further preferred embodiment, the first extension wall is substantially perpendicular to the first curved base wall at their connecting edge with a draft angle for mould release for resting on a base plate. The substantially perpendicular arrangement is suitable to provide a strong shell. The draft angle can be 15°, 12°, 10°, 8° or less. More specifically, the draft angle can be 4°~5° for providing an optimum balance between the desired strength of the shell and the ease of mould release, depending material properties of the first shell for vacuum forming.

The first curved base wall can further comprise a first centre joint for joining the first shell and the second shell together. The first centre joint unites the first shell and the second shell together for providing a complete and continuous surface of the first curved wall. The first centre joint makes it convenient to assemble the two shells, which avoids complex structure. The shells can thus be made simple at low cost.

The first curved base wall may further comprise a wall frame that supports the first shell and the second shell. The wall frame or simply frame provides a brace that augments structural integrity of the first curved wall. The modular shelter can accept the first curved base wall with a thin wall. For example, the shells of the modular shelter can be built with poly lactic acid sheets of 3 mm and the modular shelter is still able to withstand a typical typhoon. In a prototype, a thinnest place of the shells can be as thin as 1.5 mm.

In an embodiment, the modular shelter comprises a second curved wall that has a shell similar to the first curved wall. The second curved wall can be contiguous or joined to the first curved wall for providing two sides of a shelter. The shelter with the two curved walls can be attached to another building for keeping goods or people inside. More curved walls, such as four curved walls can form a cubical modular shelter with an entrance at one side.

In another embodiment, the first modular shelter comprises another gutter in another curved wall. The other curved wall is mounted on top of the first curved wall such that the other gutter is aligned to the gutter of the first curved wall for water drainage to the ground. In particular, the other curved wall can be roof that rests on top of the first curved wall. The two gutters are linked such that water drained from the other curved wall is directed from the other gutter to the gutter on the first curved wall for drainage. This arrangement prevents rain water from entering an interior of modular shelter.

In yet another embodiment, the first modular shelter further comprises a conduit or tube that connects the gutter of the first curved wall to the other gutter of the top curved wall for preventing water from entering an interior of the first modular shelter. At a joint between the first curved wall and the top curved wall, the conduit or the tube provides a sealed channel for passing the water. The modular shelter is thus suitable for withstanding heavy rains or snowing.

In a further embodiment, the modular shelter comprises the wall frame that further comprises a corner joint for connecting corners of neighboring curved walls. The wall frame joins the neighboring curved walls without involving adhesive such that the modular shelter can be repeatedly assembled and disassembled without adversely affecting its structural integrity. The wall frame is also useful to protect corners of the curved walls and integrity of the modular shelter.

The first modular shelter can further comprise a third curved wall and a fourth curved wall that are connected to the first curved wall and to the second curved wall for forming an enclosure. These curved walls can form an accommodation that is similar to those of frame and panel structures. If these curved walls are of similar shape and size, the modular shelter becomes cubical, suitable for storage.

The first modular shelter may further comprise a base plate that is connected to the first curved wall for securing the first curved wall to a single flat platform off the ground. Since lateral sides of the modular shelter are secured to the common platform, the modular shelter has a neat and clean floor for living. The lateral sides provide mutual support via the base plate. Since the modular shelter is sometimes used in a flooded region, the base plate provides a dry place for the hygiene of people who live inside the modular shelter.

The base plate can further comprises a channel that is connected to at least one of the gutters for draining water away from the first modular shelter. Since the gutters typically direct rain water to the base plate, the channel on the base plate further enables the rain water to be drained away from the modular shelter. The modular shelter is kept dry and clean over raining seasons.

Preferably, the first modular shelter includes a door that is movably connected to one of the curved walls or the base plate for providing an entrance to the enclosure or the first modular shelter. The door can be used to lock the entrance when necessary.

The first modular shelter may further comprise a pillar that is connected to the first curved wall for elevating the first modular shelter off the ground. The pillar is useful for supporting the modular shelter off a mushy or muddy ground. For example, the pillar or multiple of this can hold up the modular shelter off a wet ground in a wetland for observing wild animals. If the ground is uneven or has a slope, one or more of the pillars can provide support the modular shelter. The pillar may be in a wedge form or as a brick.

The pillar can comprise a shell structure. The shell structure, including that of the above-mentioned shells is lightweight and can be easily formed by molding, casting or vacuum forming. The shell pillar further enhances the portability of the modular shelter.

The shell may be stackable. For example, the shell of the pillar forms a compartment for receiving another similar pillar. Stacked pillars that are in shell forms occupy less room for storage.

The first shell can comprise a biodegradable material. The biodegradable material can be degraded aerobically with oxygen, or anaerobically, without oxygen. A term related to biodegradable material is biomineralisation, in which organic matter is converted into minerals. Biosurfactant, an extracellular surfactant secreted by microorganisms, enhances the biodegradation process. Often, the biodegradable material is generally organic material such as plant and animal matter and other substances originating from living organisms, or artificial materials that are similar enough to plant and animal matter to be put to use by microorganisms. Some microorganisms have a naturally occurring, microbial catabolic diversity to degrade, transform or accumulate a huge range of compounds including hydrocarbons (e.g. oil), polychlorinated biphenyls (PCBs), polyaromatic hydrocarbons (PAHs), pharmaceutical substances, radionuclides and metals. Major methodological breakthroughs in microbial biodegradation have enabled detailed genomic, metagenomic, proteomic, bioinformatic and other high-throughput analyses of environmentally relevant microorganisms providing unprecedented insights into key biodegradative pathways and the ability of microorganisms to adapt to changing environmental conditions. The adoption of biodegradable material makes the modular shelter more environmental friendly.

The biodegradable material may comprise one or more biodegradable plastic materials. Biodegradable plastic materials are plastics that will decompose in natural aerobic (composting) and anaerobic (landfill) environments. Biodegradation of plastics can be achieved by enabling microorganisms in the environment to metabolize the molecular structure of plastic films to produce an inert humus-like material that is less harmful to the environment. They may be composed of either bioplastics, which are plastics whose components are derived from renewable raw materials, or petroleum-based plastics which utilize an additive. The use of bio-active compounds compounded with swelling agents ensures that, when combined with heat and moisture, they expand the plastic's molecular structure and allow the bio-active compounds to metabolize and neutralize the plastic. Since the biodegradable plastics can be mass produced, the cost of the modular shelter can be more widely accepted for various regions of the world.

Biodegradable plastics typically are produced in two forms: injection molded (solid, 3D shapes), typically in the form of disposable food service items, and films, typically organic fruit packaging and collection bags for leaves and grass trimmings, and agricultural mulch. Examples of the biodegradable plastics include naturally produced materials, such as Polyhydroxyalkanoates (PHAs) like the poly-3-hydroxybutyrate (PHB), polyhydroxyvalerate (PHV) and polyhydroxyhexanoate (PHH). The biodegradable plastics further include those from renewable resources, such as Polylactic acid (PLA). The biodegradable plastics also include synthetic materials, such as Polybutylene succinate (PBS), polycaprolactone (PCL). Polyanhydrides, Polyvinyl alcohol and most of the starch derivatives are known biodegradable plastics too.

Preferably, the biodegradable plastics comprise poly lactic acid (PLA). The PLA is both renewable and can be mass produced at low cost for building the modular shelters at a large scale.

The first curved wall can further comprise an opening for providing a window of the first modular shelter. The opening allows streams of fresh air entering into and leaving the modular shelter. The opening can also be used as an observatory window for start gazing.

The opening may be provided at the first extension wall for ventilation. The first extension wall, which can be located at a top of the first curved base wall, provides both privacy and airing to the modular shelter such that the modular shelter can be used as a toilet or as a clothe changing room.

Preferably, the first modular shelter further comprises a fastener (e.g. bolt and nut) for joining the first sidewall and the second sidewall in forming a rib. The fastener can alternatively be provided for joining the first shell and the second shell together at other parts of the shells. The fastener allows the two shells to be connected for assembling and detached for storage. The fastener enables repeated usage of the modular shelter for reducing its cost.

The first shell can comprise a thermal insulation material. The thermal insulation material can help to make the modular shelter more inhabitable in a cold region because the interior of the modular shelter can be kept warmer than the outside. In practice, an interior wall or exterior wall of the modular shelter can be coated with heat insulation material for hindering heat radiation.

The first shell, the second shell or any of the shells can comprise a waterproof material or soundproof. In fact, all curved walls of the modular shelter can be made with the waterproof material such that the modular shelter can withstand heavy rain falls. The soundproof material helps to maintain quieter ambient inside the modular shelter.

One or more portion of the first shell can be opaque, transparent or semitransparent. Especially, one or more of the curved wall of the modular shelter can be opaque, transparent or semitransparent. A transparent shell can be used as a window for receiving sunshine. An opaque modular shelter promotes privacy. Alternatively, one or more of the shells can include structures of window blinds for both privacy and ventilation.

In a preferred embodiment, the first curved wall, the second curved wall and the third curved wall are connected for forming lateral sides of the first modular shelter. The fourth curved sidewall resides on tops of the other three curved walls for providing a roof. The base plate is further provided at bottoms of the first curved wall, the second curved wall and the third curved wall at an opposite side of the fourth curved wall for forming the enclosure with an opening side. The modular shelter is space efficient and structurally adaptable.

Two of more of the shells of one or more of the curved walls can be connected together by the centre joint. One or more of the shells are joined together by one or more the wall frames. The wall frame, although optional, can provide extra support to maintain structural integrity of the modular shelter.

The application also can provide an extended modular shelter that comprises the first modular shelter and another modular shelter similar to the first modular shelter. The other modular shelter can be identical to the first modular shelter, or can be similar to the first modular shelter in shape, size, material, structure, weight, color, location or else. In other words, multiple modular shelters can be connected to form a cluster of modular shelters, namely the expanded modular shelter. Especially, the expanded modular shelter provides multiple modular shelters whose curved walls can be neighboring to, facing or connected to each other. The expanded modular shelter can be stronger than the single modular shelter and also can accommodate more goods and people at a single site.

The other modular shelter may be connected to a roof of the first modular shelter. This arrangement forms a two-story shelter, which better utilizes vertical space. The two-story expanded modular shelter is suitable for storing goods.

According to a second aspect of the invention, the present application provides a kit of parts for constructing the first modular shelter. The first modular shelter also comprises a first shell in a disassembled form for providing a first curved wall of the first modular shelter. The first shell comprises a first curved base wall and a first sidewall for facing and connecting to another side wall of a similar shell in forming a rib of the first curved wall. The first sidewall extends from a first shell edge of the first curved base wall for supporting the first curved base wall. As mentioned earlier, the first shell is made robust by the first sidewall such that the first curved base wall is able to hold its curvature again external pressure with a thin crust.

According to a third aspect of the present invention, the application provides a method for making a first modular shelter. The method comprises a first step of providing a mould and a sheet material, a step of vacuum forming the sheet material on the mould for providing a first shell. The first shell comprises a curved base wall and a first sidewall. The first sidewall extends from a first shell edge of the first curved base wall. The method also optionally comprises a fourth step of forming corrugations on the first sidewall.

The present method can produce components of the modular shelter at low cost and a high production rate. Since a sheet material can be vacuum formed on a mould and the vacuum forming step takes about a few minutes typically, a large number of modular shelter can be manufactured quickly. The mould can be machined from a MDF (Medium Density Fiberboard board) block, which is relatively soft for fast cutting. Aluminum material based mould can replace the MDF block for making the mould if a larger amount of shells are to be made. Alternatively, the first shell can be casted, injection-molded or machined depending on situations.

The method can include a step of bending an edge or a portion of the first shell in forming a gutter since the vacuum forming typically has difficulty in producing a narrow channel. The gutter not only can increase structural strength of the first shell, but also provide structure for connecting the first shell to other shells. Bending a plastic sheet to form the gutter can be achieved with high accuracy at low cost.

The method may further include a step of forming another edge or portion of the first shell in from a tongue for inserting into the first gutter. The tongue can have a suitable thickness and length for a snug fitting with the gutter such that the two shells can be integrated into a single piece for forming the first curved wall.

Preferably, the method further comprises a step of forming a first extension wall that extends from a further edge of the first shell. The step of forming can either be a separate step or be integrated into the vacuum forming step. The step of forming the extension may further integrated with a step of forming a roughened surface, such as providing a corrugated region. In fact, some of the previously mentioned steps can be combined into a single action or step. For example, the vacuum forming step and the bending step can be combined as a single step for reducing production time and increasing structural accuracy.

According to a fourth aspect of the present invention, the application provides a method of storing or transporting the first modular shelter. The method comprises a step of stacking the first shell and the second shell together. The stacking action reduces an overall size of the two shells, as compared to two scattered shells. The stacking also provides a stronger assembly against disturbance, such as knocking or shaking during transportation. Cost of storage and transportation can be reduced when the two shells are stacked because the stacked shells are more compact, as compared to the two separate shells.

According to a fifth aspect of the present invention, the application provides a method for assembling the modular shelter. The method comprises a step of joining the first shell and the second shell together by the first centre joint. The centre joint simplifies structural design of the shells for connected them together. In fact, the first modular shelter can have all of its curved walls made from a single design, based on the first shell. The base plate can be modified to secure bottom edges of the curved walls such that one only needs one type of mould for producing the shells.

According to a sixth aspect of the present invention, the application provides a method for disassembling the modular shelter that comprises a step of disconnecting the first shell and the second shell. Disassembled shells are easy for storage and transportation.

According to a seventh aspect of the present invention, the application provides a method for using the modular shelter. The method comprises a step of recycling one or more of the shells.

According to an eighth aspect of the present invention, the application provides a method for discarding the first modular shelter. The method comprises a step of disposing the shells into an environment for biodegradation. For example, the shells can be buried in the earth.

According to a ninth aspect of the present invention, the application provides a device for making the shell. The device comprises a mould for deforming a sheet material to form the first curved base wall. The mould can be metal (e.g. aluminum) or other materials (e.g. rubber).

The accompanying figures (Figs.) illustrate embodiments of the present application and serve to explain principles of the disclosed embodiments. It is to be understood, however, that these figures are presented for purposes of illustration only, and not for defining limits of relevant inventions.

Figure 4:
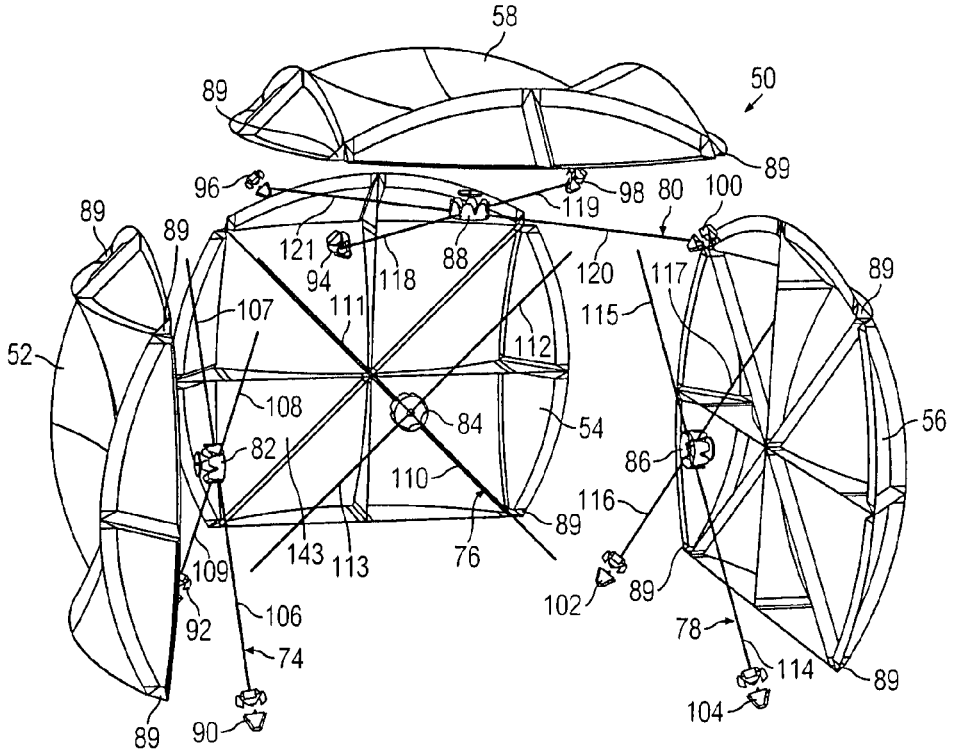

FIG. 4 an exploded view of the modular shelter with the four walls.

Figure 5:
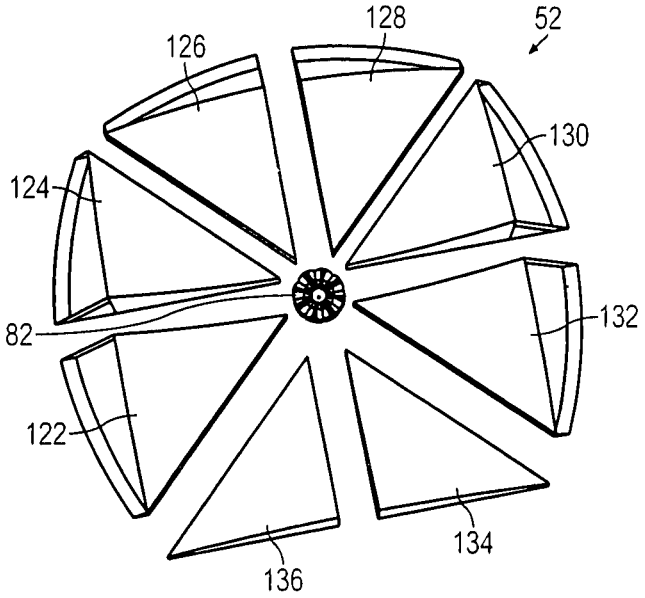

FIG. 5 illustrates an exploded view of a first curved wall that has eight shells.

Figure 6:
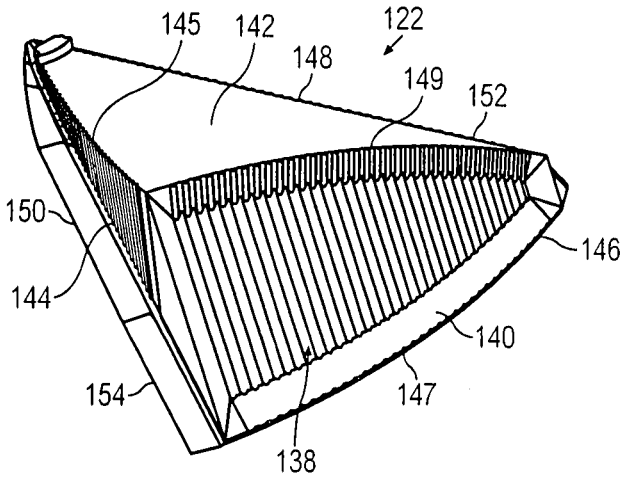

FIG. 6 illustrates a perspective view of a first shell with two gutters and a first corner extension.

Figure 7:
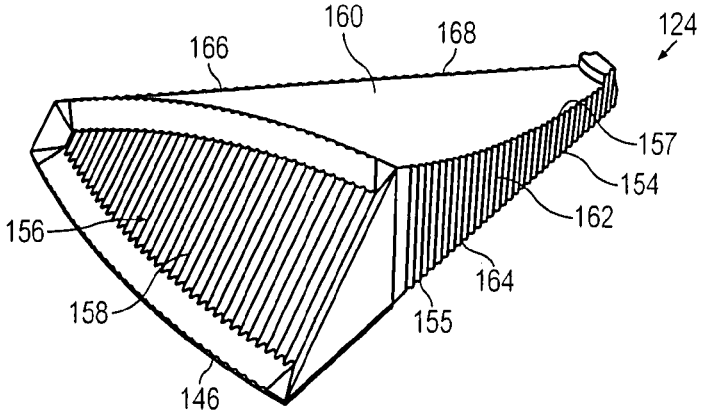

FIG. 7 illustrates a perspective view of a second shell with a second corner extension.

Figure 8:
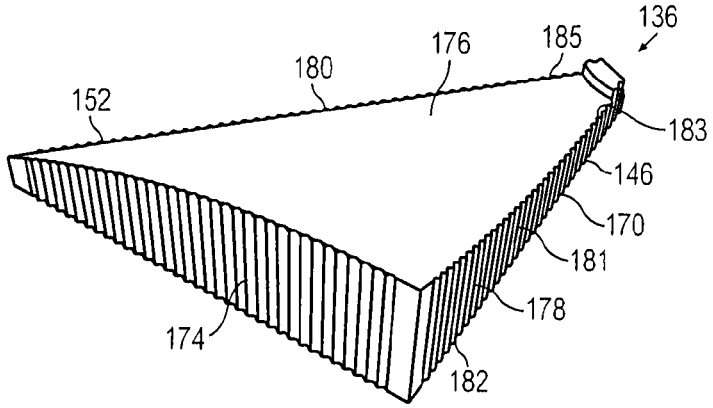

FIG. 8 illustrates a perspective view of the eighth shell with two tongues, but without a corner extension.

Figure 9:
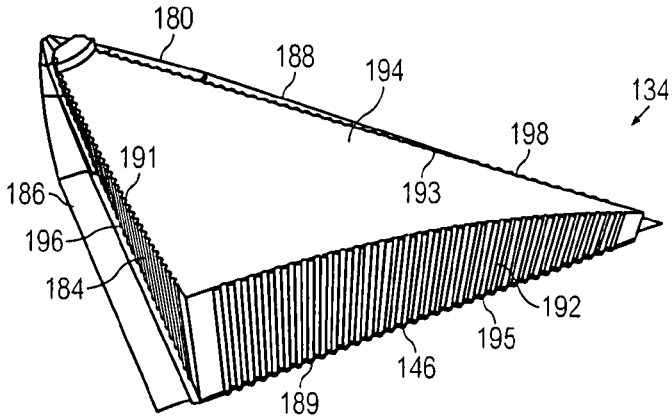

FIG. 9 illustrates a perspective view of a seventh shell with two gutters, having no corner extension.

Figure 10:
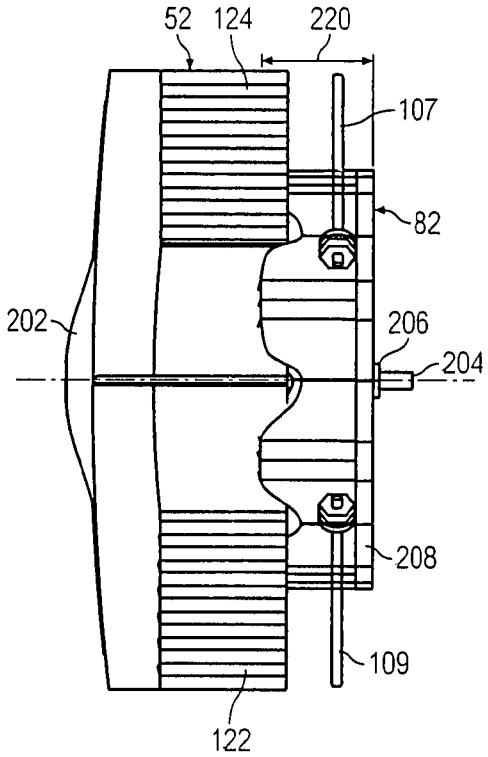

FIG. 10 illustrates the first curved wall that is joined by a first centre joint.

Figure 11:
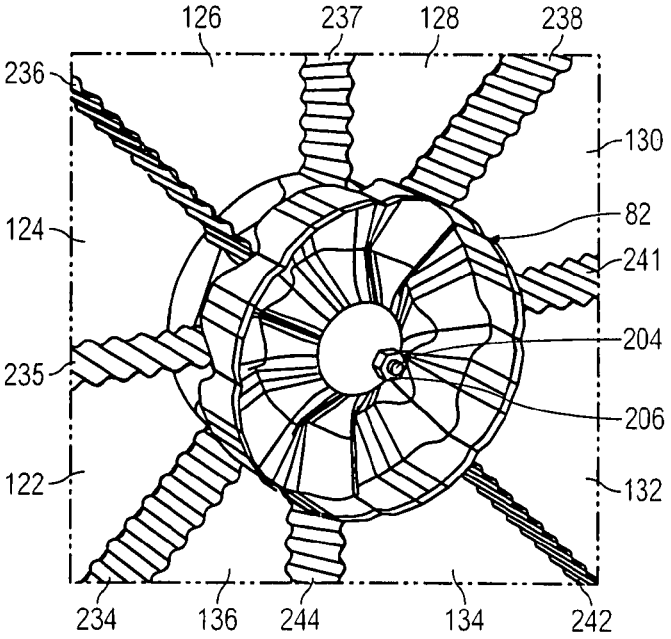

FIG. 11 illustrates a perspective view of the first centre joint.

Figure 12:
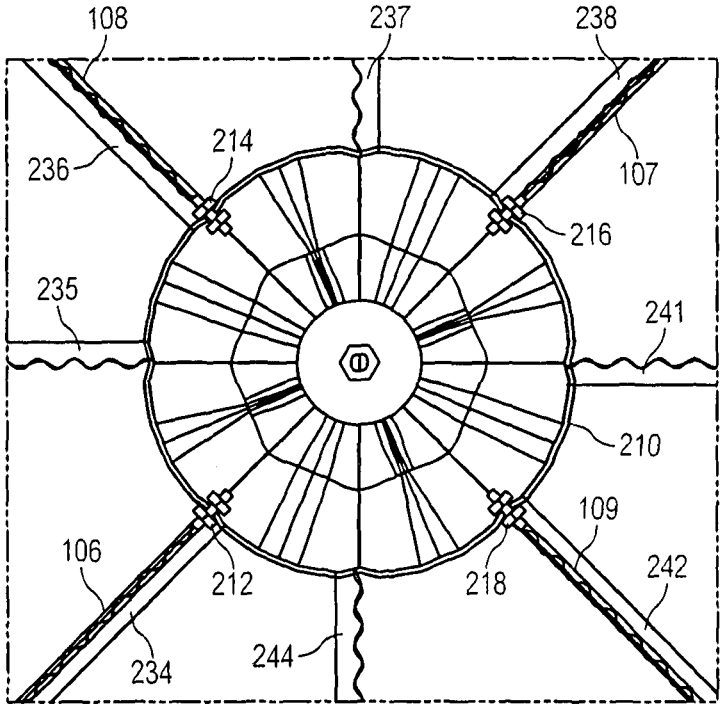

FIG. 12 illustrates the first curved wall that is joined by the first centre joint.

Figure 13:
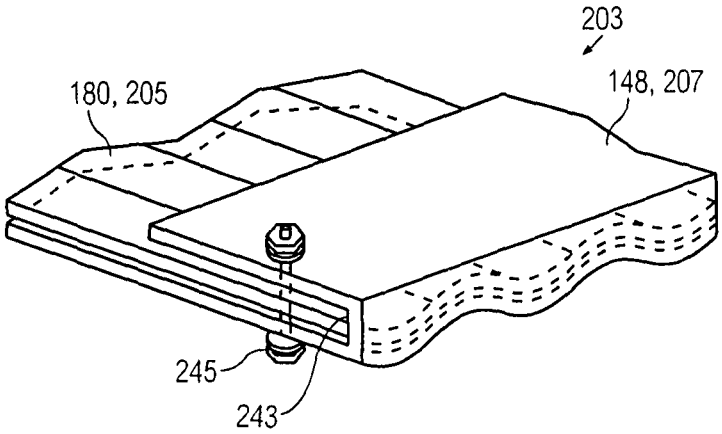

FIG. 13 illustrates how a tongue and a gutter are joined together.

Figure 14:
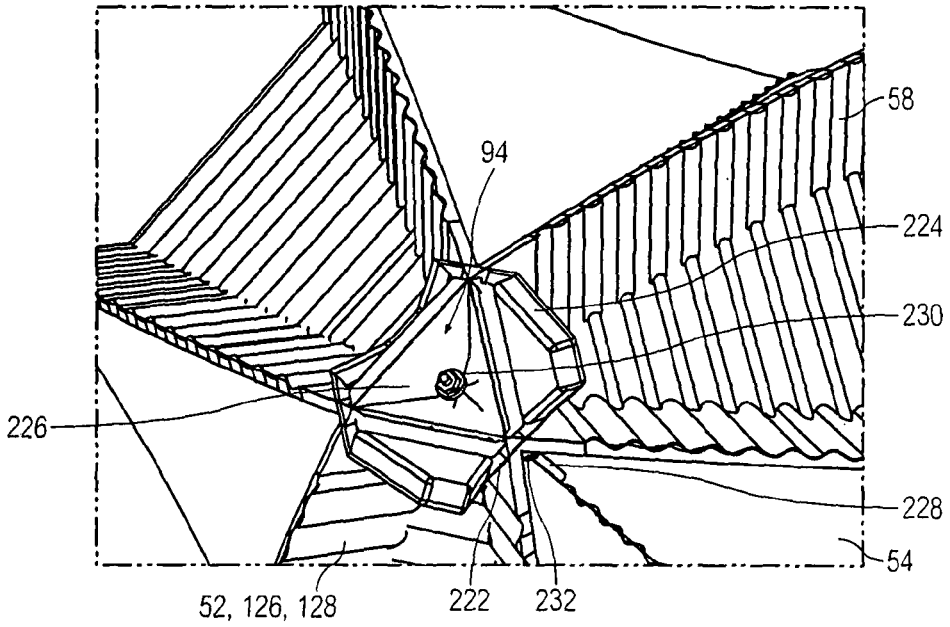

FIG. 14 illustrates a third corner joint that binds the first curved wall and a fourth curved wall together.

Figure 15:
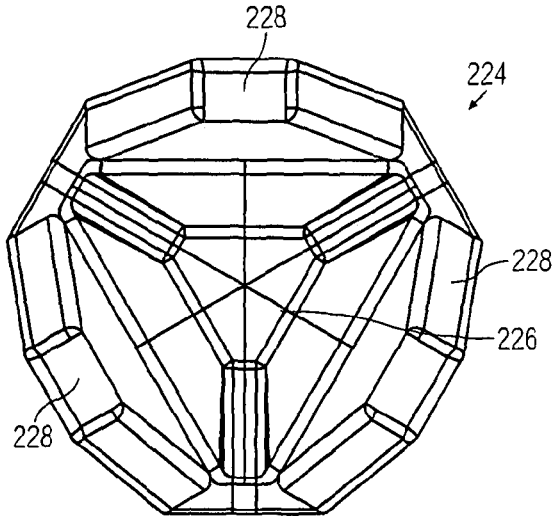

FIG. 15 illustrates a top view of an outer corner piece of a third corner joint.

Figure 16:
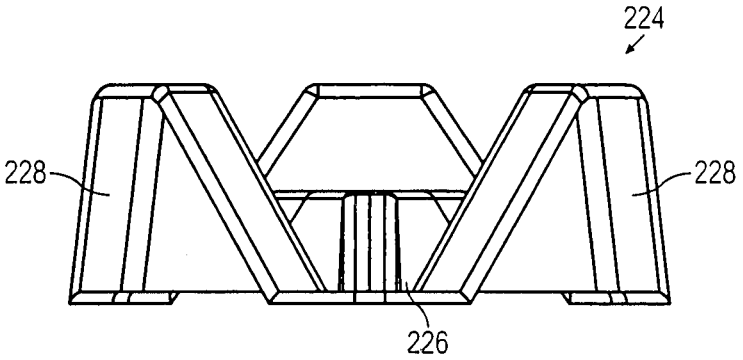

FIG. 16 illustrates a front view of the outer corner piece of the third corner joint.

Figure 17:
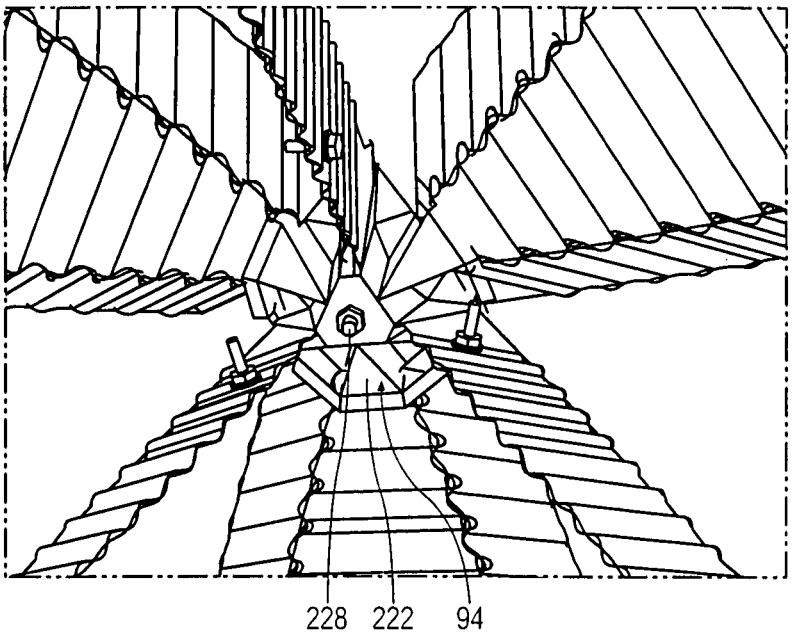

FIG. 17 illustrates the third corner joint viewing from an interior position of the modular shelter.

Figure 18:
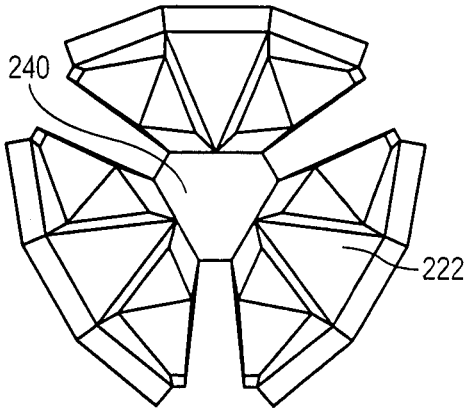

FIG. 18 illustrates a top view of the third corner joint.

Figure 19:
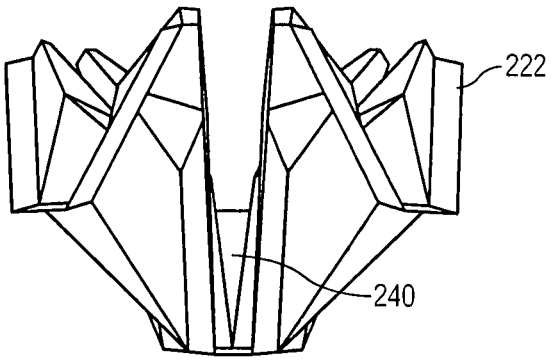

FIG. 19 illustrates a front view of the inner corner piece.

Figure 20:
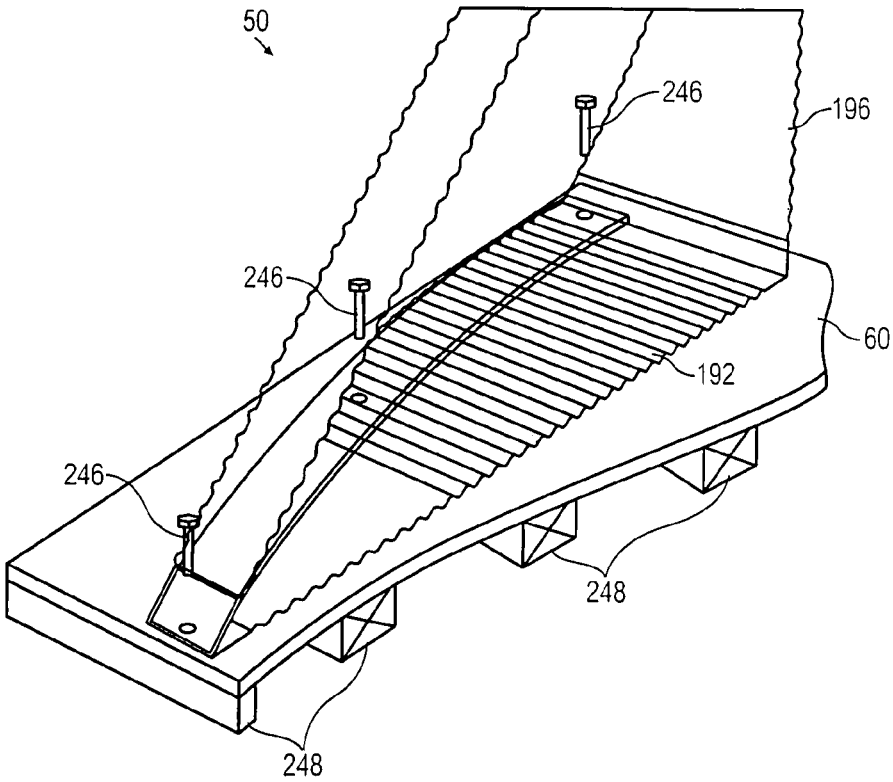

FIG. 20 illustrates a seventh shell on a base plate.

Figure 21:
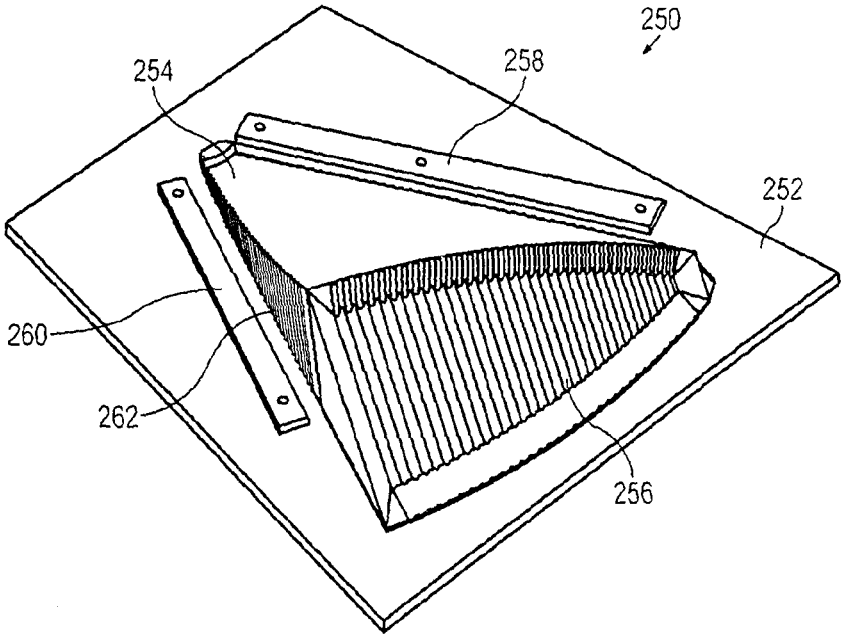

FIG. 21 illustrates a first mould for making the first shell of FIG. 6.

Figure 22:
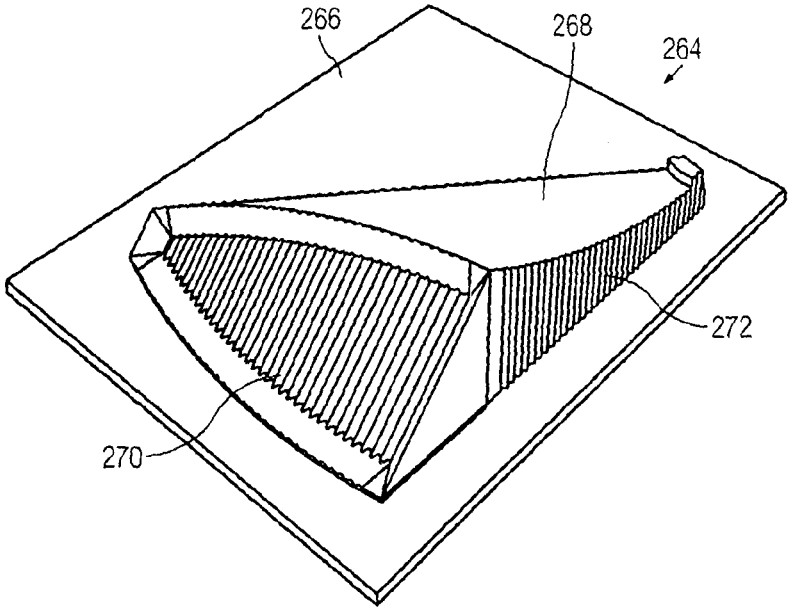

FIG. 22 illustrates a second mould for making the second shell of FIG. 7.

Figure 23:
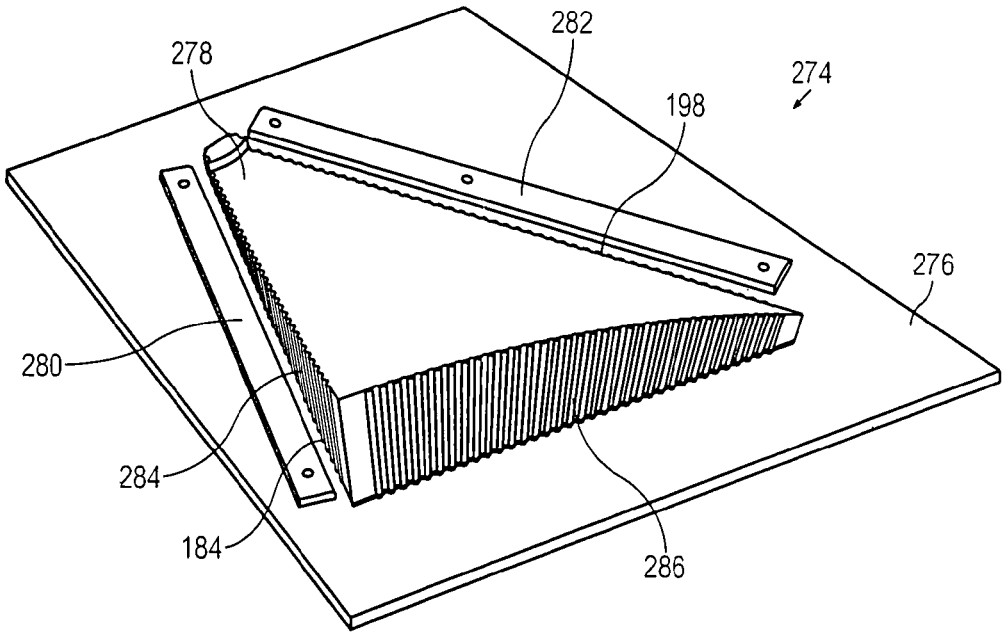

FIG. 23 illustrates a third mould for making the eighth shell of FIG. 8.

Figure 24:
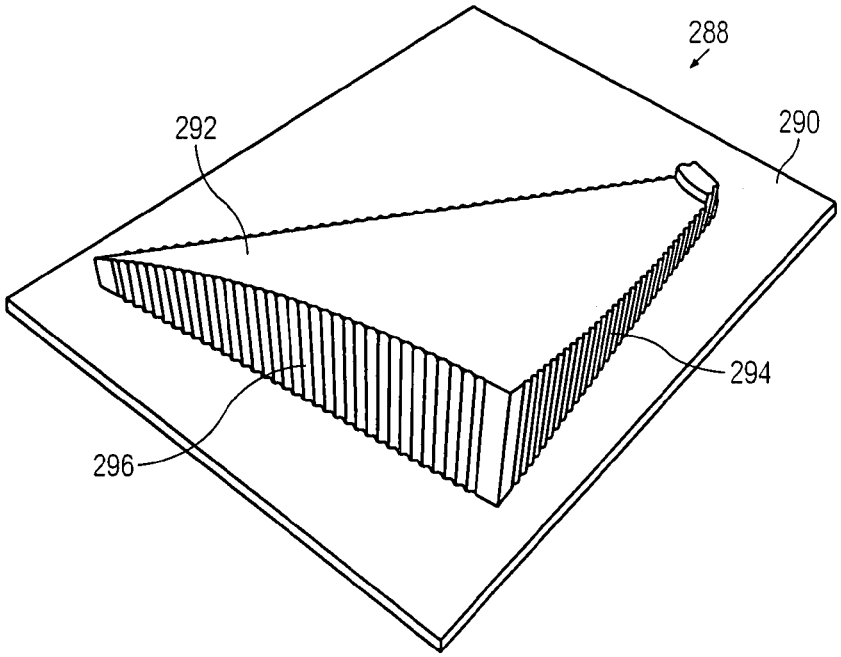

FIG. 24 illustrates a fourth mould for making the seventh shell of FIG. 9.

Figure 25:
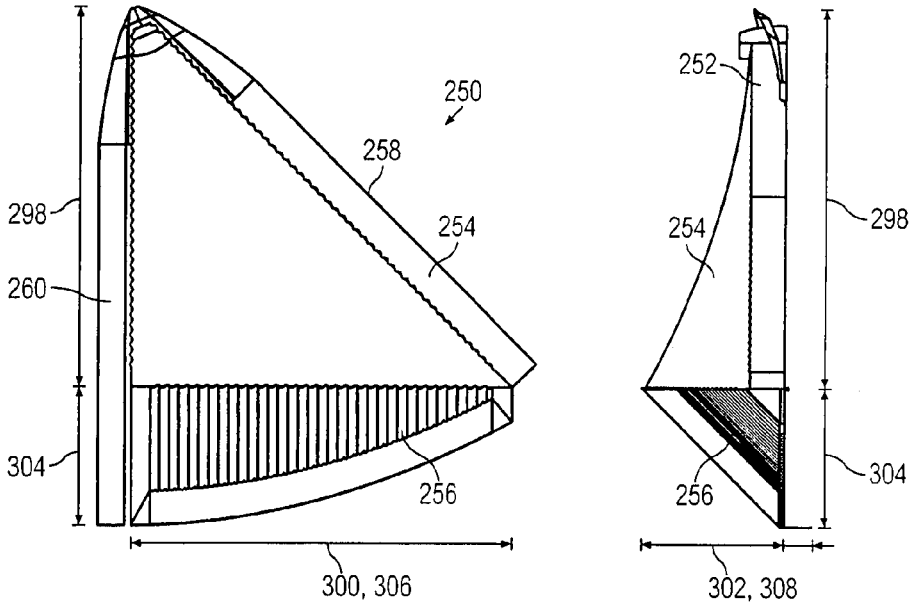

FIG. 25 illustrates dimensions of the first mould.

Figure 26:
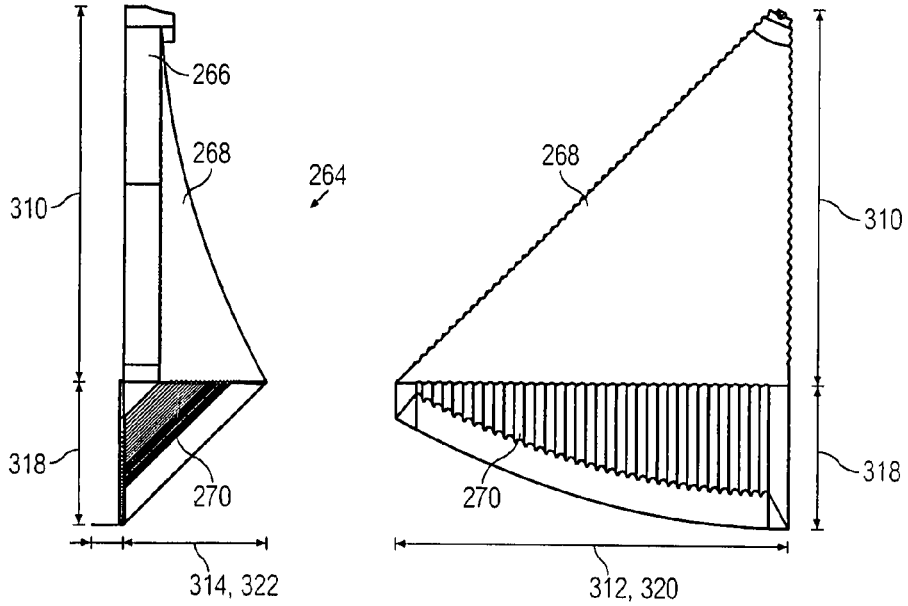

FIG. 26 illustrates dimensions of the second mould.

Figure 27:
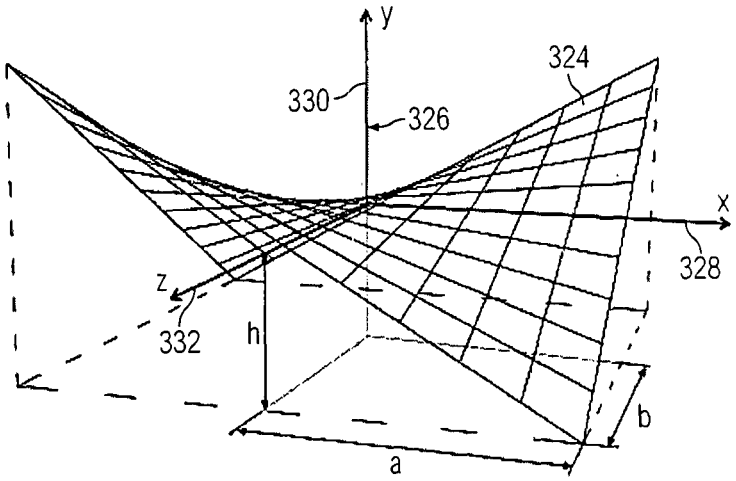

FIG. 27 illustrates a surface profile of the first shell component that is hyperbolic paraboloid.

Figure 28:
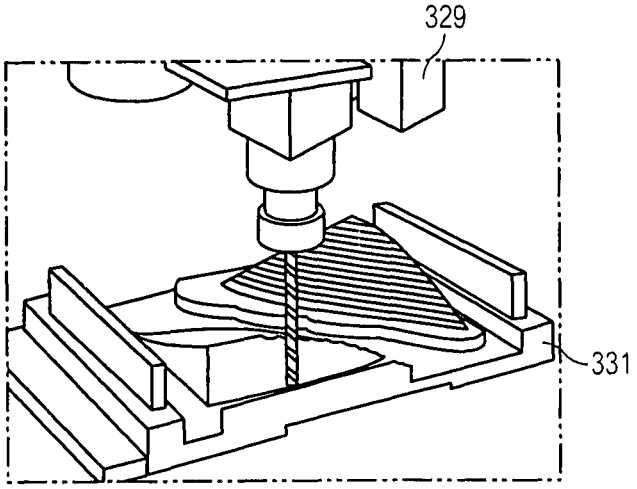

FIG. 28 illustrates a milling step for making the first mould from a MDF block.

Figure 29:
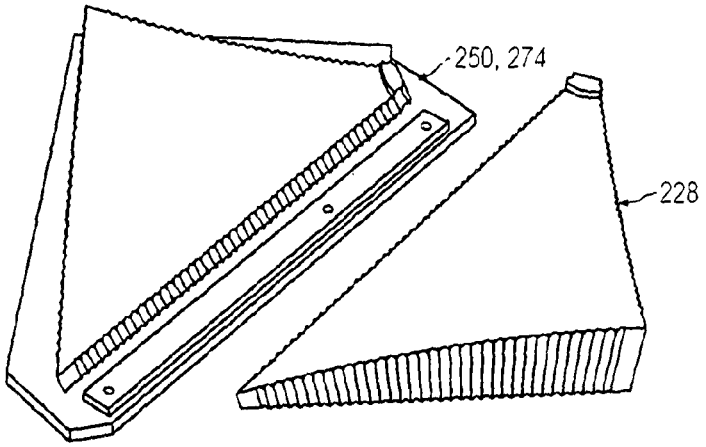

FIG. 29 illustrates portions of two finished moulds for vacuum forming.

Figure 30:
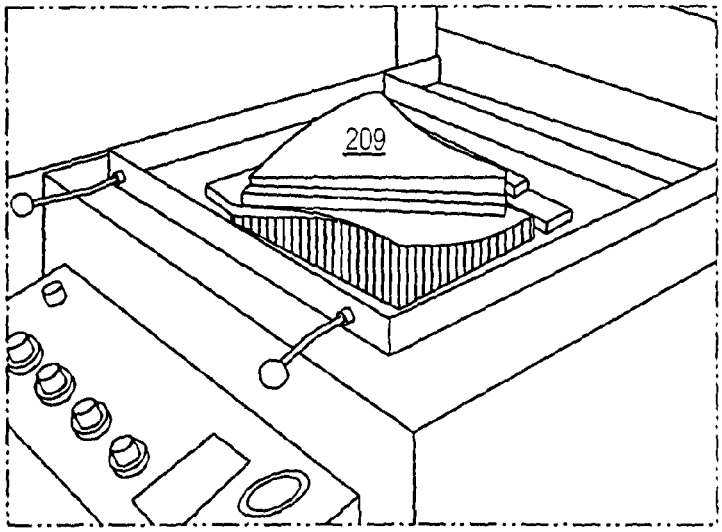

FIG. 30 illustrates a vacuum forming step with a digitally fabricated synthetic plastic mould by Computer Numerical Controlled (CNC) machining.

Figure 31:
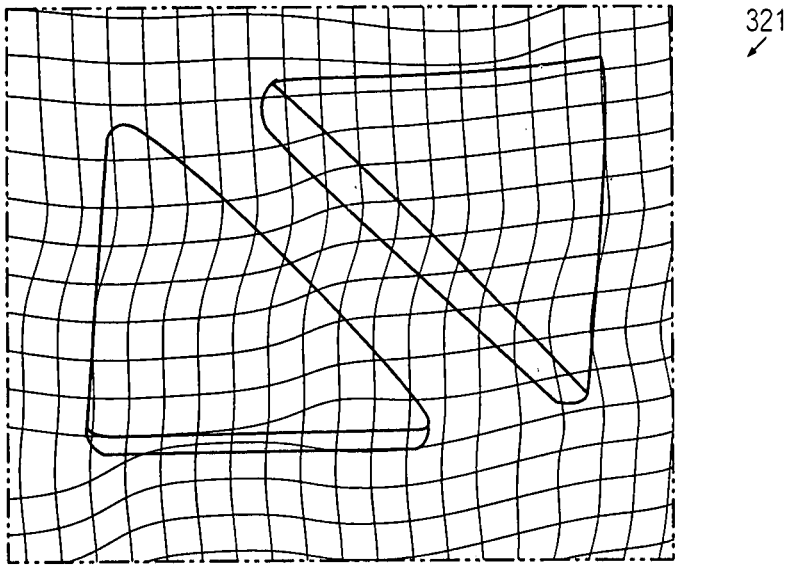

FIG. 31 illustrates a vacuum forming stretch testing.

Figure 32:
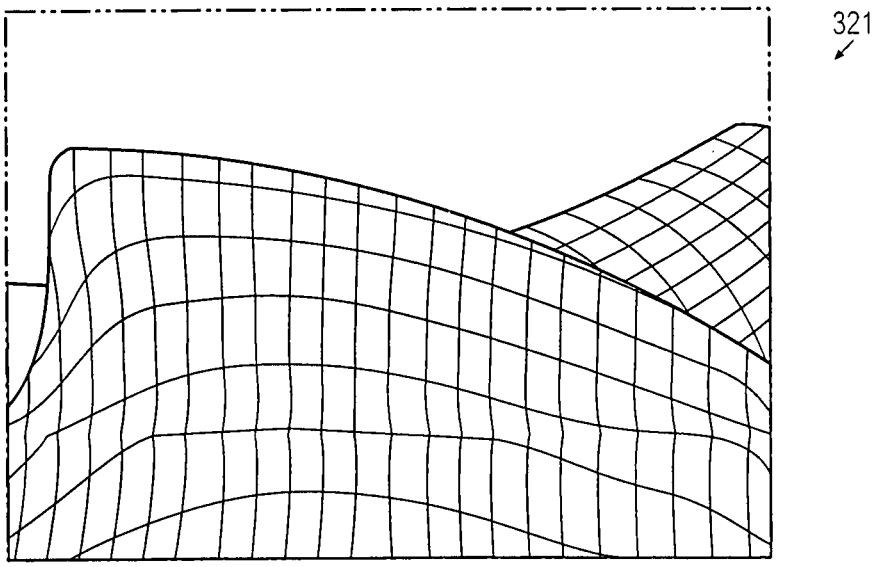

FIG. 32 illustrates a stretched PLC sheet by the vacuum forming.

Figure 33:
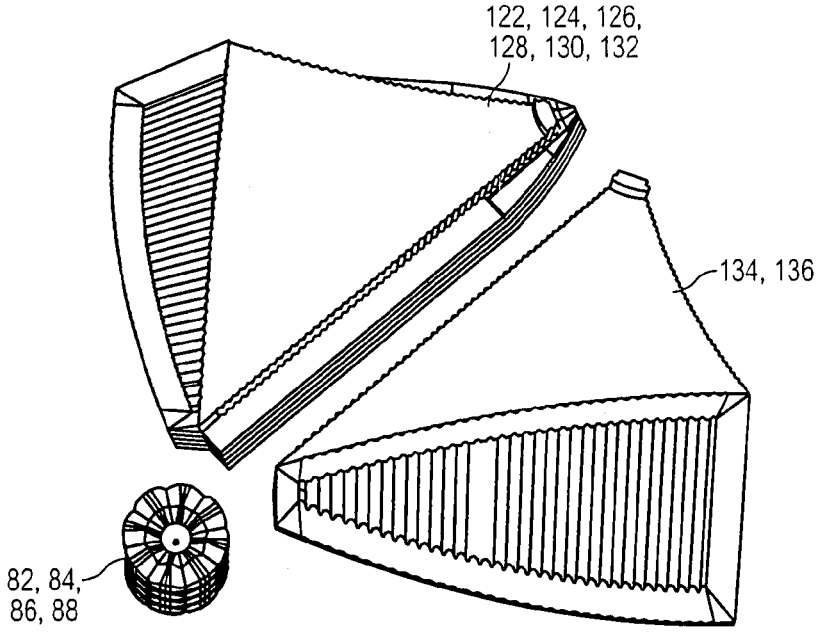

FIG. 33 illustrates stacked shells and a centre joint.

Figure 34:
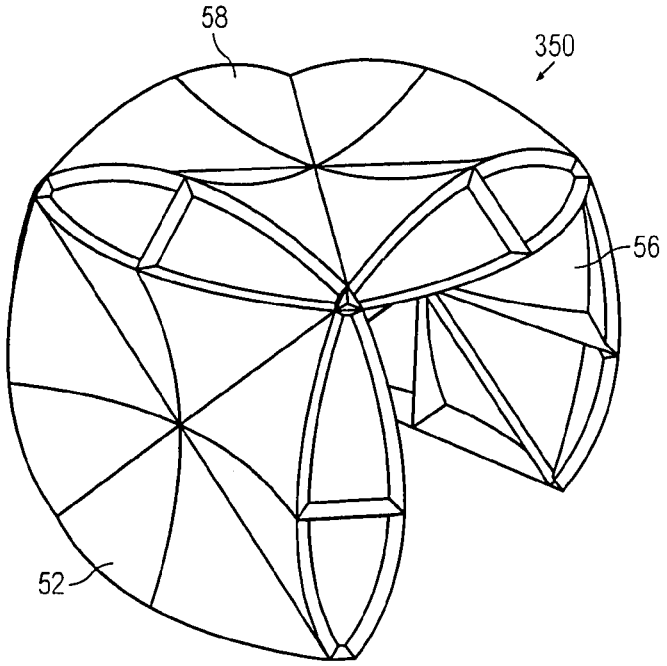

FIG. 34 illustrates a second modular shelter with three walls.

Figure 35:
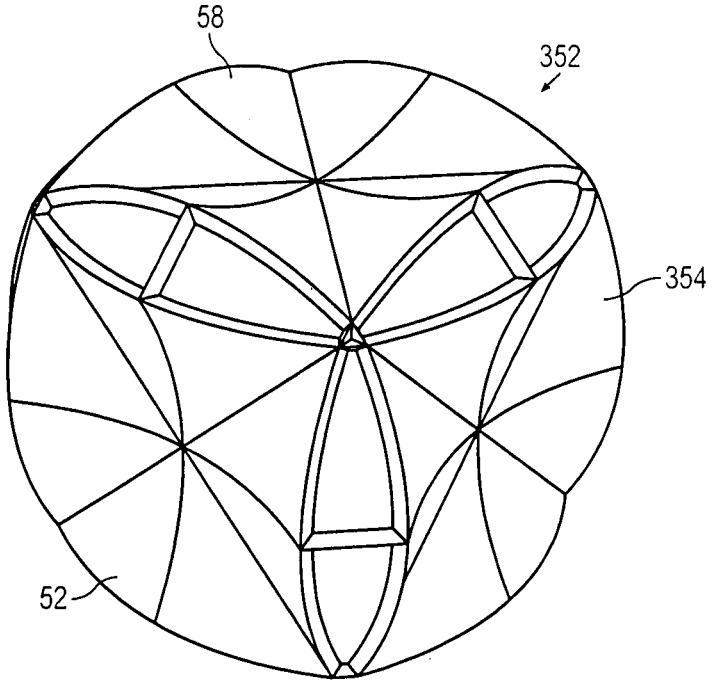

FIG. 35 illustrates a third modular shelter with five walls respectively.

Figure 36:
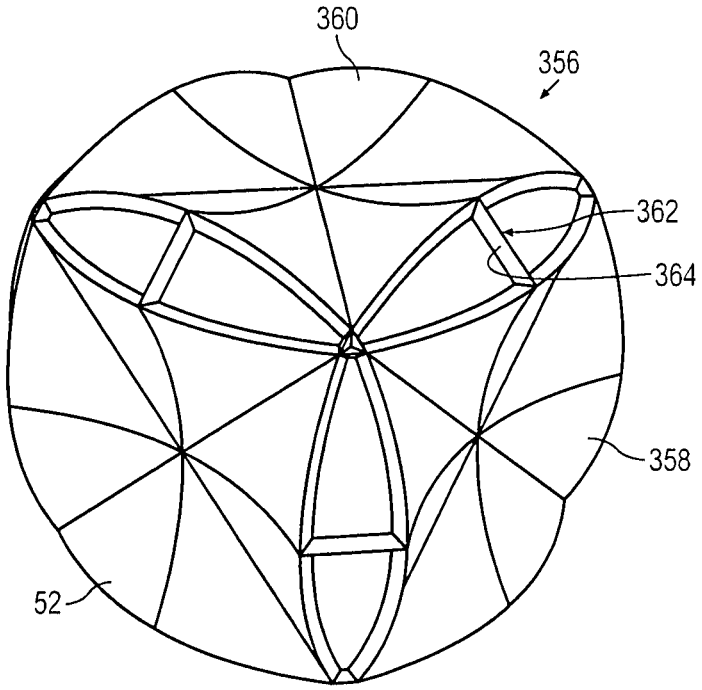

FIG. 36 illustrates a fourth modular shelter with its corner removed for ventilation.

Figure 37:
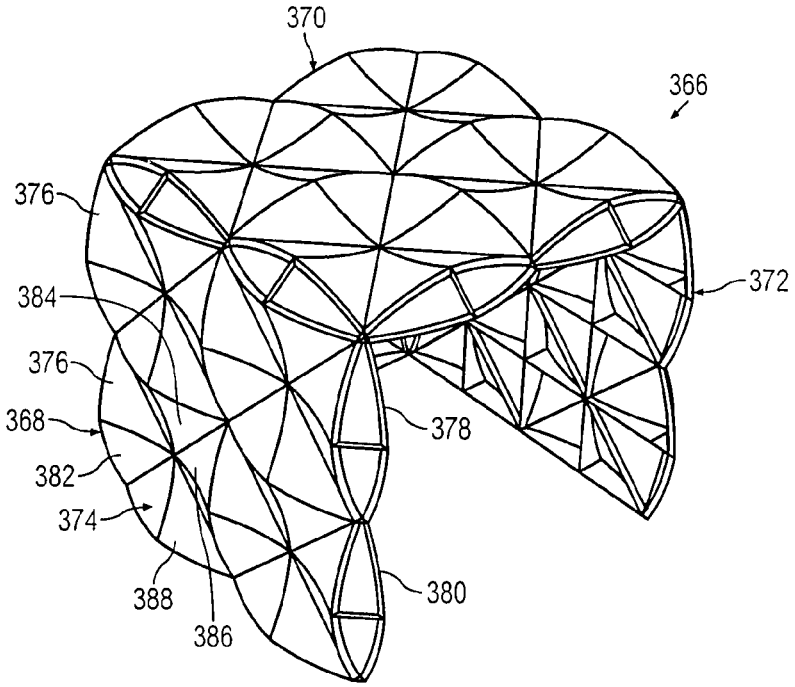

FIG. 37 illustrates a fifth modular shelter with three walls.

Figure 38:
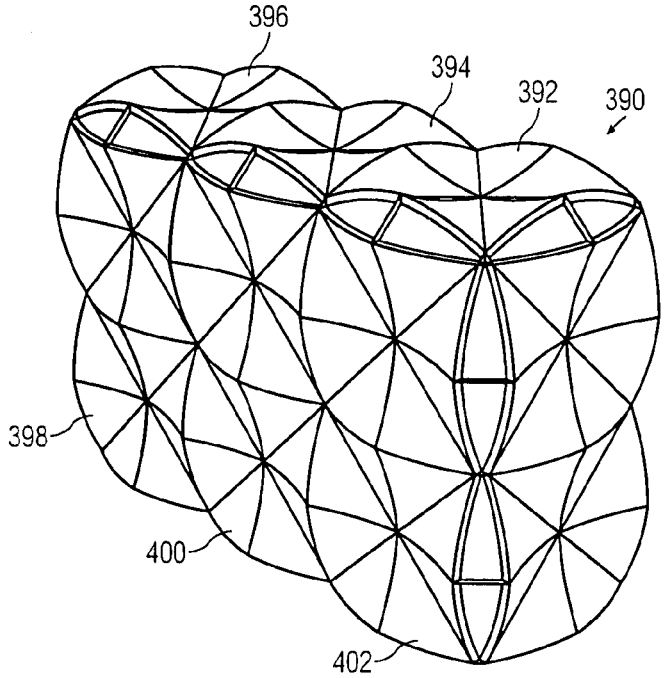

FIG. 38 illustrates a sixth modular shelter with multiple modular shelter units.

Figure 39:
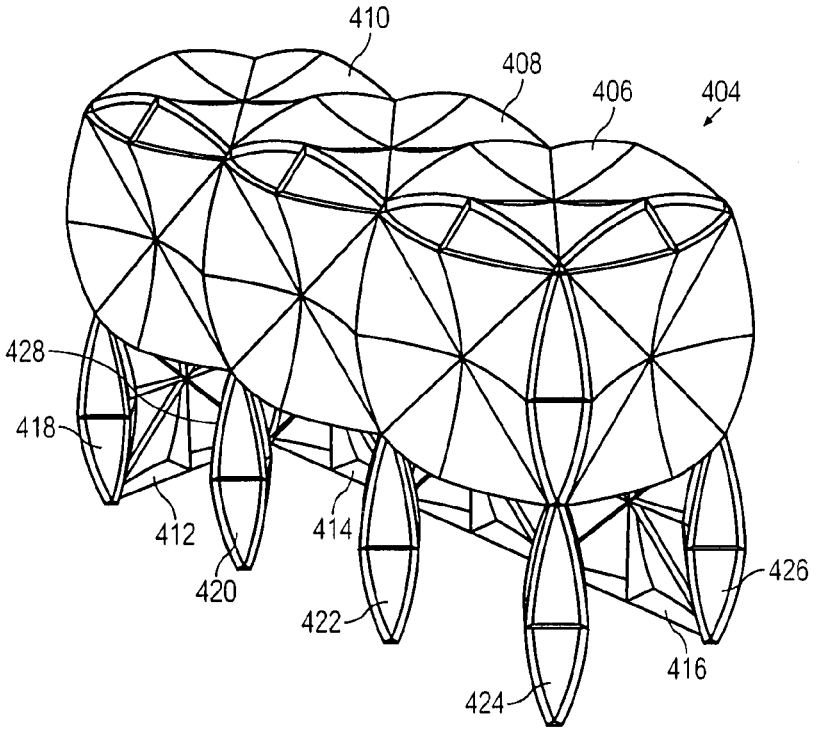

FIG. 39 illustrates a seventh with multiple modular shelter units elevated.

Figure 40:
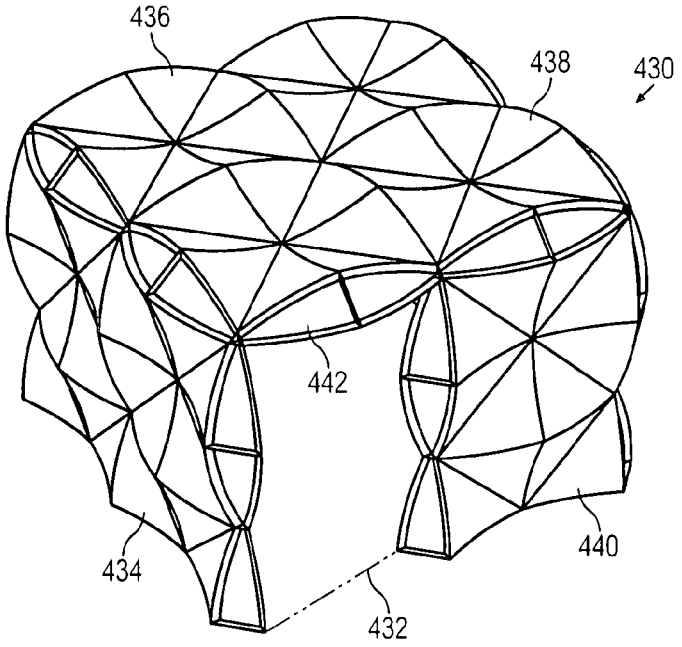

FIG. 40 illustrates an eighth modular shelter with a side entrance.

Exemplary, non-limiting embodiments of the present application will now be described with references to the above-mentioned figures.

Figure 1:
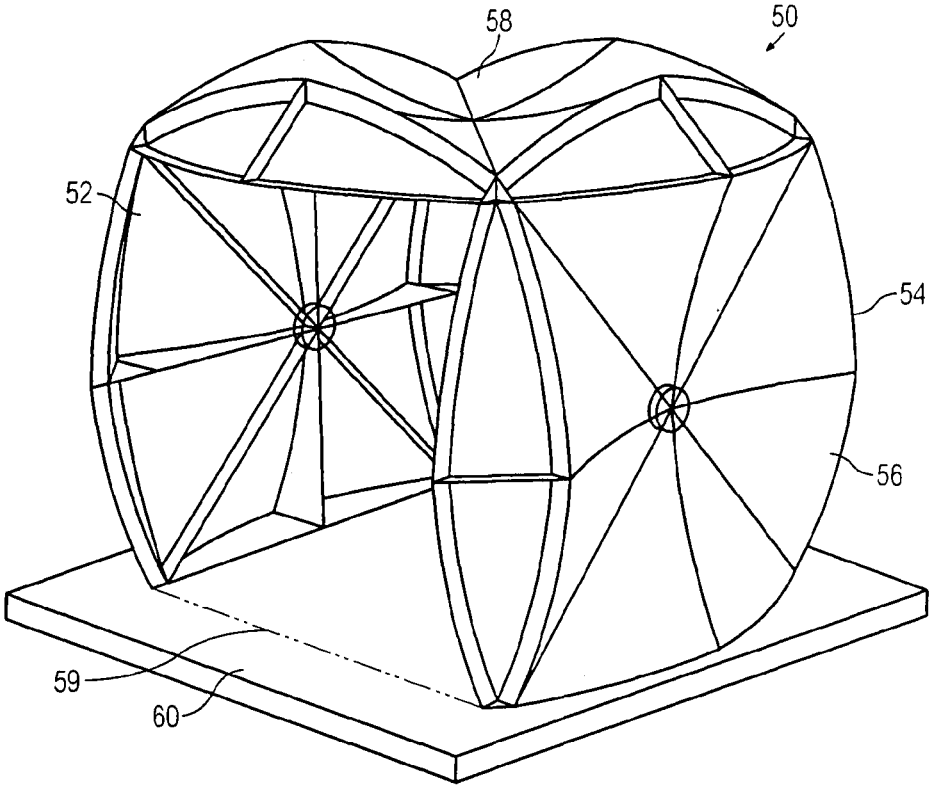
FIG. 1 illustrates a modular shelter that utilizes multiple shells to form each of its walls.

FIGS. 1 to 33 relate to a first embodiment of the present application. In particular, FIG. 1 illustrates a first modular shelter 50 that utilizes multiple shells to form each of its curved walls 52, 54, 56, 58. The first modular shelter 50 can be more conveniently referred as the modular shelter 50 or the shelter 50. A fourth curved wall 58, which serves as a roof of the modular shelter 50 is also known as a ceiling or roof. The modular shelter 50 opens at its front side 59 and has a base plate 60 as its floor. Top portions of the three walls 52, 54, 56 are connected to an underside of the fourth curved wall 58, whilst bottom portions of the three walls 52, 54, 56 stand on the base plate 60. The three curved walls 52, 54, 56 are joined together sequentially at their lateral sides such that the modular shelter 50 has a cubical shape substantially.

In detail, a first curved wall 52 is provided on a right side of the modular shelter 50; a second curved wall 54 is provided on a backside of the modular shelter 50; whilst a third curved wall 56 is provided on a left side of the modular shelter 50. The fourth curved wall 58 is on an opposite side of the base plate 60. The modular shelter 50 has no wall at its front side 59, which is an opposite side of the second curved wall 54. Each of these curved walls 52, 54, 56, 58 are linked together by ribs, corner joints and frames which are described later in further detail.

Figure 2:
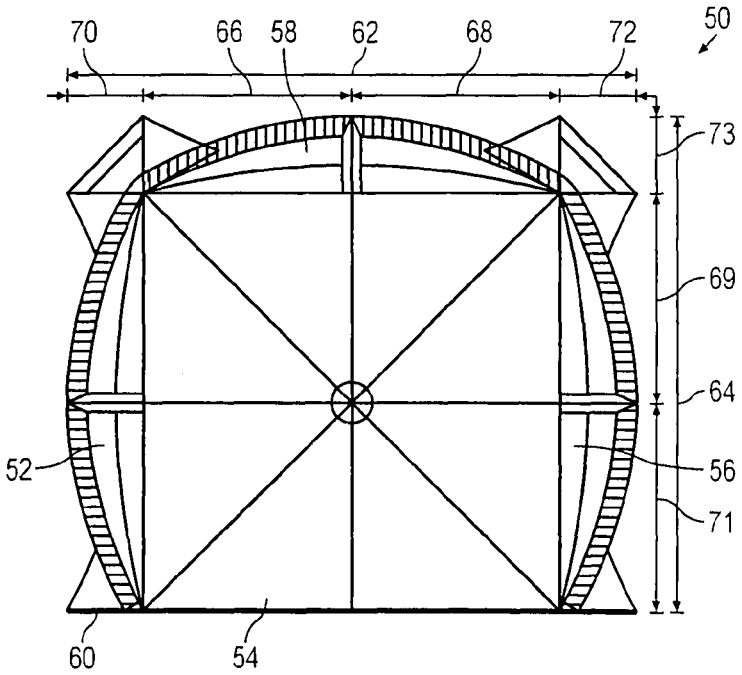
FIG. 2 illustrates a front view of the modular shelter with dimensions.

FIG. 2 illustrates a front view of the modular shelter 50 with dimensions. These dimensions are labeled by numerical values whose units are in millimeters (mm). According to FIG. 2, the modular shelter 50 has a width 62 of about 3,000 mm and a height 64 of about 2,600 mm. FIG. 2 shows that each curved wall 52, 54, 56, 58 of the modular shelter 50 has a curved portion that protrudes beyond its base plane.

These dimensions indicate that each of the curved walls 52, 54, 56, 58 is generally symmetrical such that the modular shelter 50 has a substantially cubical form. For example, the fourth curved wall (roof/ceiling) 58 has a left-width 66 of about 1,100 mm and a right-width 68 of about 1,100 mm. The fourth curved wall 58 also has a left corner width 70 of a corner extension at 400 mm and a right corner width 72 of another corner extension at 400 mm too. Similarly, the third curved wall (left wall) 56 has an upper height 69 of 1,100 mm and a lower height 71 of 1,100 mm. However, the third curved wall 56 only has one corner extension on top whose top corner width 73 is also about 400 mm. Dimensions of the first curved wall 52 are similar to those of the third curved wall 56.

Figure 3:
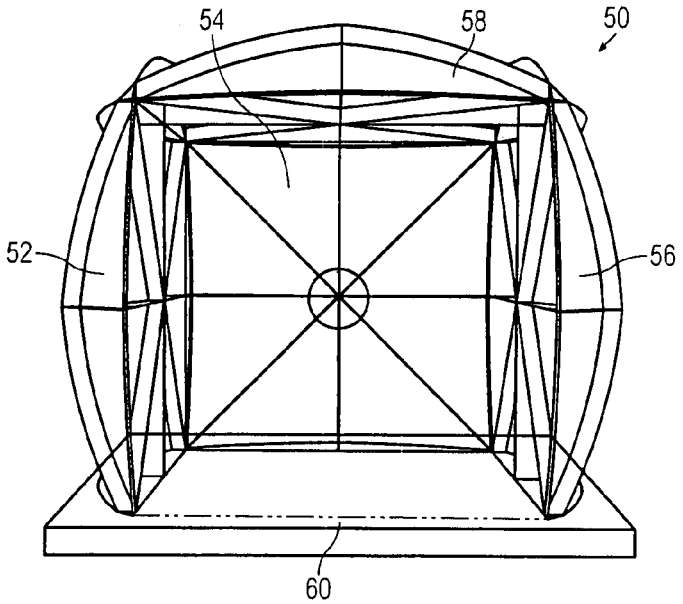
FIG. 3 illustrates an axonometric projection of the modular shelter.

FIG. 3 illustrates an axonometric projection of the modular shelter 50. The axonometric projection presents structural details of the four walls 52, 54, 56, 58 that have the ribs, the corner joints and the frames for holding the walls 52, 54, 56, 58 together. The corner joints and the frames are also known as braces that enhance structural integrity of the modular shelter 50. In other words, the modular shelter 50 is primarily held together by the ribs and the frames. The ribs include serrated portions of the walls 52, 54, 56, 58.

FIG. 4 illustrates an exploded view of the modular shelter 50 with the four walls 52, 54, 56, 58. The exploded view omits the base plate 60, but gives more details to the corner joints and the frames. Generally speaking, each of the walls 52, 54, 56, 58 has a wall frame 74, 76, 78, 80 that is connected to a centre joint 82, 84, 86, 88. Neighboring corners 89 of the walls 52, 54, 56, 58 are connected and further strengthen by corner joints 90, 92, 94, 96, 98, 100, 102, 104.

Specifically, the first curved wall frame 74 has a first bar 106, a second bar 107, a third bar 108 and a fourth bar 109 that join at their inner ends with a first centre joint 82. At an outer end of the first bar 106, a first corner joint 90 is attached to the first bar 106 for attaching to the first curved wall 52. At an outer end of the fourth bar 109, the fourth bar 109 is connected to a second corner joint 92. Inner ends of the first bar 106, the second bar 107, the third bar 108 and the fourth bar 109 are joined to the first centre joint 82.

A fifth bar 110, a sixth bar 111, a seventh bar 112 and an eighth pair bar 113 are anchored by their inner ends at the second centre joint, These four bars 110, 111, 112, 113 are parts of a second curved wall frame 76. The second curved wall frame 76 is located in front of the second curved wall 54 and has no corner joint.

Similarly, a third curved wall frame 78 has a ninth bar 114, a tenth bar 115, an eleventh bar 116 and a twelfth bar 117 that are linked to a third centre joint 86 at their inner ends. A seventh corner joint 102 is provided at an outer end of the eleventh bar 116, whilst an eighth corner joint 104 is provided at an outer end of the ninth bar 114 for attaching to the third curved wall 56.

Below the fourth curved wall 58 (ceiling/roof), a fourth curved wall frame 80 has a thirteenth bar 118, a fourteenth bar 119, a fifteenth bar 120 and a sixteenth bar 121 tied to a fourth centre joint 88 at their inner ends. The fourth curved wall frame 80 has four corner joints 94, 96, 98, 100 at outer ends of these four bars 118-121. The corner joints include a third corner joint 94 at an outer end of the thirteenth bar 118, a fourth corner joint 96 at an outer end of the sixteenth bar 121, a fifth corner joint 98 at an outer end of the fourteenth bar 119 and a sixth corner joint 100 at an outer end of the 120.

The third corner joint 94 unites the first curved wall 52 and the fourth curved wall 58 at two outer ends of the third bar 108 and the thirteenth bar 118, which further bonds front ends of the first curved wall 52 and the fourth curved wall 58 together. The fourth corner joint 96 fastens back ends of the first curved wall 52 and the fourth curved wall 58 together. The fifth corner joint 98 connects back ends of the third curved wall 56 and the fourth curved wall 59. The sixth corner joint 100 holds front ends of the third curved wall 56 and the fourth curved wall 58 together.

The bars 106-121 are substantially aligned to the ribs of the walls 52-58, which are shown in FIGS. 1-4. In particular, any of the bars 106-121 provides additional structural support to the modular shelter 50, although the ribs are generally sufficient for upholding the modular shelter 50.

FIG. 5 illustrates an exploded view of a first curved wall 52 that has eight shells 122-136. Shells that are similar to those of the first curved wall 52 also found in the second curved wall 54, the third curved wall 56 and the fourth curved wall 58. In fact, each of the second curved wall 54 and the third curved wall 56 has eight shells that are similar to those of the first curved wall 52.

Referring to FIG. 5, the first curved wall 52 has a first shell 122, a second shell 124, a third shell 126, a fourth shell 128, a fifth shell 130, a sixth shell 132, a seventh shell 134 and an eighth shell 136 that are sequentially arranged in a clockwise direction. Each of the shells 122-136 has a narrow end that points towards and is connected the first centre joint 82. The first shell 122, the second shell 124, the third shell 126, the fourth shell 128, the fifth shell 130, the sixth shell 132, the seventh shell 134 and the eighth shell 136 are further serially connected and neighboring to each other at their lateral sides. These shells 122-136 have four types, which are better seen in FIGS. 6-9 respectively.

FIG. 6 illustrates a perspective view of the first shell 122 with two gutters 148, 150 and a first corner extension 138. The first shell 122 bulges above a wall plane 146 and further forms a pocket 147 opening towards the wall plane 146. The pocket 147 has three inter-connected sidewalls, including a first serrated slope 140, a first hyperbolic paraboloid sidewall 142 and a first serrated divider 144. The first serrated divider 144 extends up almost vertically from a first shell edge 145 of the first hyperbolic paraboloid sidewall 142. The first corner extension wall 138 extends from another edge 149 of the first hyperbolic paraboloid sidewall 142 for joining a corner extension of a shell 143 on the second curved wall 54 (see FIG. 4). The first serrated slope 140, the first hyperbolic paraboloid sidewall 142 and the first serrated divider 144 form the pocket 147 whose opening end on the wall plane 146 is larger than a footprint of the first hyperbolic paraboloid sidewall 142 (i.e. projection on the wall plan 146). A first gutter 148 is provided on a first side 152 of the first shell 122 and extends over an entire length of the first side 152. A second gutter 150 is provided along a second side 154 of the first shell 122 and extends over an entire length of the second side 154. The first gutter 148 and the second gutter determine lie flat substantially on the wall plane 146. The first shell 122 has another wall which is not visible in FIG. 6. The other wall is contiguously connected to both the first serrated divider 144 and the first corner extension wall 138. The other wall joins to the other two sidewalls 138, 144 and encloses all edges of the first hyperbolic paraboloid sidewall 142. This arrangement is also found in other shells 124, 126, 128, 130, 132, 134, 136. In FIG. 6, the two gutters 148, 150 are in their intermediate form after vacuum forming. In their final forms, the two gutters 148, 150 are bent to form U-shaped channels, which are also found with other gutters.

FIG. 7 illustrates a perspective view of the second shell 124 with a second corner extension 156. Similar to the first shell 122, the second shell 124 bulges above the wall plane 146 and forms a pocket opening towards the wall plane 146. The pocket 155 is formed by three inter-connected sidewalls, including a second serrated slope 158, a second hyperbolic paraboloid sidewall 160 and a second serrated divider 162. The second serrated divider 162 extends up almost vertically from an edge 157 of the hyperbolic paraboloid sidewall 160. The second serrated slope 158, the second hyperbolic paraboloid sidewall 160 and the second serrated divider 162 form the pocket 155 whose opening on the wall plane 146 is larger than a footprint of the hyperbolic paraboloid sidewall 160. The second shell 124 has no gutter, but has a second tongue 164 along the second side 154. The second tongue 164 is integral with the second serrated divider 162 and extends over the entire length of the second side 154 for fitting into the second gutter 150 when assembled. The second shell 124 further has a third tongue 166 that extends along almost an entire length of the third side 168. The third tongue 166 is similar to the second tongue 164 and both of the tongues 164, 166 can lie flat along the wall plane 146. The second serrated divider 162 can match with the first serrated divider 144 such that they can be closely attached together when the second tongue 164 is inserted into the second gutter 150 for assembling. Serrations of the first serrated divider 144 and the second serrated divider 162 match each other. The match fitting provides friction and alignment between the two shells 122, 124 and they are further securely bonded together by a fastener (e.g. screw and nut in FIG. 13).

FIG. 8 illustrates a perspective view of the eighth shell 136 with two tongues 170, 180, but without a corner extension. The eighth shell 136 bulges above the wall plane 146 and forms a pocket 181 opening towards the wall plane 146. The pocket 181 has three inter-connected sidewalls, including a first serrated base 174, a third hyperbolic paraboloid sidewall 176 and a third serrated divider 178. Both the first serrated base 174 and the third serrated divider 178 extend up almost vertically from two edges 183, 185 of third hyperbolic paraboloid sidewall 176. The first serrated base 174, the third hyperbolic paraboloid sidewall 176 and the third serrated divider 178 form a chamber 181 whose opening is larger than a footprint of the third hyperbolic paraboloid sidewall 176. A first tongue 180 is provided on the first side 152 of the eighth shell 136 and extends over the entire length of the first side 152. A fourth tongue 170 is provided along a fourth side 182 of the eighth shell 152 and extends over an entire length of the fourth side 182. The fourth tongue 170 is integral with the third serrated divider 178.

FIG. 9 illustrates a perspective view of a seventh shell 134 with two gutters 186, 188, but without a corner extension. The seventh shell 134 protrudes above the wall plane 146 and forms a pocket 189, which opens towards the wall plane 146. The pocket 189 has three inter-connected sidewalls, including a second serrated base 192, a fourth hyperbolic paraboloid sidewall 194 and a fourth serrated divider 196. Both the second serrated base 192 and the fourth serrated divider 196 extend up almost vertically from edges 191, 193 of the fourth hyperbolic paraboloid sidewall 194. The second serrated base 192, the fourth hyperbolic paraboloid sidewall 194 and the fourth serrated divider 196 form a chamber/pocket 195 whose opening is larger than a footprint of the fourth hyperbolic paraboloid sidewall 194. A third gutter 186 is provided on the fifth side 184 of the seventh shell 134 and extends over the entire length of the fifth side 184. A fourth gutter 188 is provided along a sixth side 198 of the seventh shell 134 and extends over an entire length of the sixth side 198. Both the third gutter 186 and the fourth gutter 188 can lie flat along the wall plane 164. The third gutter 186 receives the fourth tongue 170 for assembling.

FIG. 10 illustrates the first curved wall 52 that is joined by the first centre joint 82. FIG. 10 is depicted when a viewer stands near the front side 59 of the modular shelter 50 and look into the modular shelter 50. In FIG. 10, the eighth shell 136, the first shell 122, the second shell 124 and the third shell 126 are taken away from the first curved wall 52 for exposing the first centre joint 82 in an assembled position.

As shown in FIG. 10, the first centre joint 82 comprises a first outer plate 202, a first bolt 204, a first nut 206 and a first inner plate 208. Both the first outer plate 202 and the first inner plate 208 have two through holes at their centers (not shown/visible) respectively such that the first bolt 204 passes the central through holes and joins the first outer plate 202 and the first inner plate 208 together. The first outer plate 202 and the first inner plate 208 are tightened together by a screw joint, including the first bolt 204 and the first nut 206. The first outer plate 202 is pushed against the narrow ends of the eight shells 122-136 in the assembled position. The first inner plate 208 has a profile that matches contours of the eight shells 122-

136. In particular, the first inner plate 208 rids on the gutters and tongues of eight shells 122-136 such that the eight shells 122-136 are held together sturdily. A rib of the first curved wall 52 is formed when a tongue is inserted into a corresponding gutter in the assembled position of FIG. 1. FIG. 10 shows that a thickness 220 of the first inner plate 208 is about 100 mm.

FIG. 11 illustrates a perspective view of the first centre joint 82. The perspective view gives a better picture on how the profile of the first inner plate 208 matches the profiles of the eight shells 122-136. In other words, FIG. 10 depicts that the first inner plate 208 matches profiles of a first rib 234, a second rib 235, a third rib 236, a fourth rib 237, a fifth rib 238, a sixth rib 241, a seventh rib 242 and an eighth rib 244.

The first rib 234 is formed by the first serrated divider 144 and the second serrated divider 162 when first tongue 180 is inserted into the first gutter 148 for assembling. The second tongue 164 is inserted into the second gutter 150 for forming the second rib 235. Remaining ribs 236, 237, 238, 241, 242, 244 are formed by neighboring sidewalls of the shells 122-136 when tongues are inserted into corresponding gutters respectively.

FIG. 12 illustrates the first curved wall 52 that is joined by the first centre joint 82. At a first peripheral 210 of the first centre joint 82, there are four screw sets 212-218 for connecting the first curved wall frame 74. The four screw sets 212-218 consist of a first screw set 212, a second screw set 214, a third screw set 216 and a fourth screw set 218. FIG. 12 shows that a diameter of the first outer plate 202 is about 400 mm.

FIG. 13 illustrates a front view of a corrugated friction joint 203. The corrugation friction joint 203 comprises a first tongue 180 and the first gutter 148 that mated together. The corrugation joint 203 provides the first rib 234 that supports the first curved base wall 52. The walls 205, 207 that form the first tongue 180 and the first gutter 148 respectively are also shown. The first gutter 148 is further shown in its final bent form. The first gutter 148 effectively forms a conduit 243 for guiding water flow within its boundary.

FIG. 14 illustrates the third corner joint 94 that binds the first curved wall 52 and the fourth curved wall 58 together. The third corner joint 94 comprises an inner corner piece 222 and an outer corner piece 224 and a corner screw set 226. The corner screw set 226 further comprises a corner screw 228, a corner washer 230 and a corner nut 232. The corner screw 228 has a threaded bolt that passes through centre holes (not shown) of the inner corner piece 222 and the outer corner piece 224 for clamping the first curved wall 52 and the fourth curved wall 58 together. The corner screw set 226 also have rubber washers that contact the first curved wall 52 and the fourth curved wall 58 respectively for providing a waterproof joint. Each of the inner corner piece 222 and the outer corner piece 224 is about 5 mm thick respectively.

FIG. 15 illustrates a top view of the outer corner piece 224. The outer corner piece 224 is generally triangular shaped in the top view. The outer corner piece 224 fits substantially within an equilateral triangle having a side length of about 250 mm. The outer corner piece 224 comprises a central bowl-shaped pocket 226 with three extensions 228 symmetrically distributed around the central bowl-shaped pocket 226.

FIG. 16 illustrates a front view of the outer corner piece 224. The front view indicates a height of the third corner piece 224 to be around 75 mm. The three extensions 228 bend downwards (only two extensions visible in FIG. 16).

FIG. 17 illustrates the third corner joint 94 viewing from an interior of the modular shelter 50.

FIG. 18 illustrates a top view of the inner corner piece 222. The inner corner piece 222 fits well within an equilateral triangle that has a side length of 200 mm.

FIG. 19 illustrates a front view of the inner corner piece 222. The front view depicts the inner corner piece 222 with a central recess 240. The central recess 240 has a depth of about 100 mm.

FIG. 20 illustrates the seventh shell 134 on the base plate 60. The second serrated base 192 of the seventh shell 134 is tightened against to the base plate 60 by three screws 246. The base plate 60 is a Medium Density Fiberboard board (MDF) that resides on an array of parallel bars 248. These bars 248 have substantially the same thickness such that the base plate 60 can lie flat on a flat ground steadily.

Referring back to FIG. 4, the fourth curved wall 58 also comprises eight shells that are similar to the first shell 122, the second shell 124, the third shell 126, the fourth shell 128, the fifth shell 130 and the sixth shell 132, but not the seventh shell 134 and eighth shell 136. The eight shells of fourth curved wall 58 are sequentially connected in a manner similar to that of the first curved wall 52. In contrast to the first curved wall 52, the fourth curved wall 58 has corner extensions around all four sides. These corner extensions rest on top of the corner extensions of the other three walls 52, 54, 56 such that their serrations match each other and prevents relative movements among each other.

In the modular shelter 50, serrated walls 140, 144, 158, 162, 174, 178, 192, 196 provide extra support to the shells 122, 124, 134, 136 for upholding shapes of these shells 122, 124, 134, 136. The two neighboring serrated walls 144, 162 further prevent the two neighboring shells 122, 124 from slipping away from an intended position for assembling the modular shelter 50. In general, two matching or mating serrated walls provide a friction joint that increase structural rigidity of the modular shelter 50.

The corner joints 90, 92, 94, 96, 98, 100 connect neighboring corners of the walls 52, 54, 56, 58 together for aligning the walls 52, 54, 56, 58 to the assembled position in FIG. 4.

Each of the centre joints 82, 84, 86, 88 link multiple shells 122-136 of a single wall 52, 54, 56, 58 together such that eight shells of the single wall 52, 54, 56, 58 is bonded together to form a panel.

FIGS. 21-33 describe how the modular shelter 50 is made, assembled and tested. In particular, FIG. 21 illustrates a first mould 250 for making the first shell 122 of FIG. 6. The first mould 250 comprises a first board component 252, a first shell component 254, a first corner component 256, a first gutter component 258 and a second gutter component 260. The first board component 252 is a piece of flat MDF (Medium Density fiberboard) board with a thickness of about 8 mm. The first shell component 254 and the first corner component 256 are joined together on a top side of the first board component 252. The first shell component 254 has a surface contour that substantially matches the first hyperbolic paraboloid sidewall 142 of the first shell 122. The first shell component 254 further has a first serrated side 262 that substantially matches with the first serrated divider 144. The first corner component 256 also has a surface contour that substantially matches an interior surface of the first corner extension 138.

The first gutter component 258 is a MDF strip that is parallel to the first side 152 of the first shell component 250, whilst the second gutter 260 component is also a MDF strip that is parallel to the second side 154 of the first shell component 250. Both the first gutter component 258 and the second gutter component 260 are placed about 5 millimeters away from the first shell component 250 respectively.

FIG. 22 illustrates a second mould 264 for making the second shell 124 of FIG. 7. The second mould 264 comprises a second board component 266, a second shell component 268 and a second corner component 270. The second board component 266 is a piece of flat MDF board with a thickness of about 8 mm. The second shell component 268 and the second corner component 270 are joined together on a top side of the second board component 266. The second shell component 268 has a surface contour that substantially matches the second hyperbolic paraboloid sidewall 160 of the second shell 124. The second shell component 268 further has a second serrated side 272 that substantially matches with the second serrated divider 162. The second corner component 270 also has a surface contour that substantially matches an interior surface of the second corner extension 156.

FIG. 23 illustrates a third mould 274 for making the seventh shell 134 of FIG. 9. The third mould 274 comprises a third board component 276, a third shell component 278, a third gutter component 280 and a fourth gutter component 282. The third board component 276 is a piece of flat MDF board with a thickness of about 8 millimeters. The third shell component 278 has a surface contour that substantially matches the fourth hyperbolic paraboloid sidewall 194 of the seventh shell 134. The third shell component 278 further has a third serrated side 284 that substantially matches with the third serrated divider 178. The third shell component 278 also has a fourth serrated side 286 that matches substantially with the second serrated base 174.

The third gutter component 280 is a MDF strip that is parallel to the fifth side 184 of the third shell component 278, whilst the fourth gutter component 282 is also a MDF strip that is parallel to the sixth side 198 of the third shell component 278. Both the third gutter component 280 and the fourth gutter component 282 are placed about 5 mm away from the third shell component 278 respectively.

FIG. 24 illustrates a fourth mould 288 for making the eighth shell 136 of FIG. 8. The fourth mould 288 comprises a fourth board component 290 and a fourth shell component 292. The fourth board component 290 is a piece of flat MDF board with a thickness of about 8 mm. The fourth shell component 292 has a surface contour that substantially matches the third hyperbolic paraboloid sidewall 176 of the eighth shell 136. The fourth shell component 292 further has a fifth serrated side 294 that substantially matches with the third serrated divider 178. The fourth shell component 292 also has a sixth serrated side 296 that matches substantially with the first serrated base 174.

FIG. 25 illustrates dimensions of the first mould 250. FIG. 25 provides a front view of the first mould 250 on the left that is aligned to a top view of the first mould 250 on the right. These dimensions are chosen according to four factors. These dimensions are firstly chosen based on a maximum production height of a CNC router (e.g. Frogmill, Streamline Automation with a maximum production height of 400 millimeter; H400). These dimensions are also chosen based on a maximum production size of commercially available vacuum-forming machine (e.g. Starcolor Technologies, W1,200×D1,800×H750 millimeter). These dimensions are further chosen based on structural strength of the material that provides the shells 122-136. These dimensions are moreover chosen for achieving optimized space efficiency. The space efficiency is determined by a volume of useful space in the modular shelter 50 over a total volume of the modular shelter 50. Higher space efficiency, which is indicated by a higher aspect ratio, can be achieved by adopting thinner shells, thinner base plate 60.

FIG. 25 indicates that the first mould 250 has an overall width of 1,500 mm that consists of a length 298 of the first shell component 254 and a length 304 of the first corner component 256. The first shell component 254 has a length of 1,100 mm, a width 300 of 1,100 mm and a height 302 of 400 mm. The first corner component 256, which is contiguous to the first shell component 254, has a length 304 of 400 mm, a width 306 of 1,100 mm and a height 308 of 400 mm. The FIG. 25 further shows that the first board component 252 has a thickness of 50 mm, whilst the two gutter components 258, 260 have a same height of 100 mm.

FIG. 26 illustrates dimensions of the second mould 264. FIG. 25 provides a top view of the second mould 264 on the left that is aligned to a front view of the second mould 264 on the right. FIG. 26 indicates that the second mould 264 has an overall length of 1,500 mm that consists of a length 310 of the second shell component 264 and a length 318 of the second corner component 270. The second shell component 264 has a length of 1,100 mm, a width 312 of 1,100 mm and a height 314 of 400 mm. The second corner component 270, which is contiguous to the second shell component 264, has a length 318 of 400 mm, a width 320 of 1,100 mm and a height 322 of 400 mm. The FIG. 26 further shows that the second board component 264 has a thickness of 50 mm.

FIG. 27 illustrates a surface 324 of the first shell component 254 that has a hyperbolic paraboloid shape. The hyperbolic paraboloid surface 324 is provided in a three-dimensional Cartesian coordinate 326 that has a X-axis 328, a Y-axis 330 and a Z-axis 332. A height 308 of the hyperbolic paraboloid surface 324 is labeled as h, a long-axis of the hyperbolic paraboloid surface 324 is labeled as a and a short-axis of the hyperbolic paraboloid surface 324 is labeled as b.

The hyperbolic paraboloid surface 324 is mathematically expressed as $$2y = \frac{x^2}{c^2} - \frac{z^2}{d^2} \tag{1}$$

In the above-mentioned first equation, c and d are constants. Under a stable load p over the surface 324 along the Y-axis 330, axial forces along the X & Y axes 328, 332 are substantially zero. Shear forces on the surface 324 are described by a second equation as:

$$N_{xz} = -\frac{ab}{2h}p = -kp \tag{2}$$

$$k = \frac{ab}{2h} \tag{3}$$

An aspect ratio a/h plays an important role in determining a load capacity of the first shell 122, especially when a is equals to b.

The geometry of the first shell 122 whose first hyperbolic paraboloid sidewall 142 conforms substantially to the hyperbolic paraboloid surface 324 is built by a Rhinoceros software package. The geometry is further imported into a Patran (2005) software package for Finite Element (FE) modeling. A FE model of the hyperbolic paraboloid surface 324 adopts eight-node shell elements (S&R n ABAQUS element library). The stable load p is uniformly applied over the first hyperbolic paraboloid sidewall 142 and a mesh of the FE model is shown by grid lines in FIG. 27. FE analyses are performed in a general-purpose FE software ABAQUS (2008), which includes both geometry and material nonlinearity.

FE modeling of the other parts of the first shell 122 is simplified, which includes for the ribs and bolts/washers. FE models of the other parts are provided by assuming structural continuity of the first shell 122 as if the first shell 122 is fabricated as a single piece in a fabrication mould. In the FE analyses, potential over estimation on the structural strength of the first shell 122 is compensated by reducing a thickness of the ribs of the first shell 122 by half.

The hyperbolic paraboloid shells are made by a vacuum forming process, which is also known as vacuforming. The vacuum forming process is a simplified version of thermoforming, whereby a sheet of plastic is heated to a forming temperature, stretched onto a single-surface mould, and held against the mould by applying vacuum between the mould surface and the sheet.

For example, the first mould 250 is prepared based on a 3D CAD model of the first shell 122 by using digital fabrication technologies. Based on the 3D CAD model, a 3D profile of the first mould 250 in the form of a mater 3D data is firstly generated by employing the 3D design software (i.e. Rhinoceros®). The master 3D data is saved in STL format and pre-processed for CNC routing in Cut 3D (Vectric) CAM software for the route pass generation. Frogmill (Streamline Automation) CNC router is used for a subtractive rapid prototyping process.

MDF is selected as a mould material of the first mould 250 for an initial stage of prototyping. The MDF material is selected because of its low material cost, its material structure and its suitability for the vacuforming process. The vacuforming is conducted at relatively low temperatures (e.g. room temperature) and low pressures. The MDF also has fine and soft grain structure, which is suitable for forming corrugated shapes by machining. The MDF is coated with high-temperature epoxy varnish for improving its surface quality and durability. Additional durability of the first mould 250, which is required by repetitive vacuforming cycles, is attained by applying surfaces of the first mould 250 with Aluminum powder filled with epoxy. The first mould 250 can alternatively be made by Polyurethane material.

The first mould 250 is firstly prepared by machining a MDF cubic piece to stepped pyramid shapes, which is close to an intended shape of the first mould 250. The first mould 250 is not carved out to the intended shape of the first mould 250 by a CNC machine for time saving.

FIG. 28 illustrates a milling step for making the first mould 250 with the MDF cubic piece 331. The milling step is conducted by using a milling machine 329 with a 10-millimeter mill drill bit for fast roughing and by subsequently employing an 8-millimeter nose for fine finishing. Detailed dimensions of the first mould 250, such as draft angles, corrugation pitches, etc, are determined by an empirical approach. The milling step, including the fast roughing and fine finishing, is repeated about four times in order to completing the empirical approach. FIG. 29 illustrates portions of two finished moulds for the vacuforming.

FIG. 30 illustrates a vacuum forming (vacuforming) step with a digitally fabricated synthetic plastic mould 209 by Computer Numerical Controlled (CNC) machining. The vacuum forming step or method is used for making industrial products with relatively simple curved shapes, such as those of washbasins and bathtubs, or for more complex but thin products, such as those of disposable cups and other packaging components. The vacuum forming method is suitable for production in small quantity because low cost of this method offsets a high initial cost of making a mould. While producing the first mould 250 is a lengthy and tedious fine-tuning process, the vacuum forming step is accomplished in a matter of minutes. The vacuum forming step/method has an advantage of rapid mass-production of complex 3-D forms. The vacuum forming step can deform a thin sheet of plastic to increase its stiffness instantly.

The shape of the first mould 250 is determined by technical parameters associated with the vacuum-forming step. For instance, the vacuum forming method requires at least a 3 to 6% outward taper all around a periphery of the first mould 250 for successful mass production of the first shell 122. For large undercuts, collapsible male moulds can be provided for convenient part removal.

A general principle of shells implies that a shell forms an enclosure is far more rigid than an open one. The closed shell describes a shell has no or few edges. The open shell describes a shell at least one or more edges that are exposed. In the present case, the first shell 122 is open at one side and the first shell 122 is reinforced by its three sidewalls at its peripheries for enhancing its structural rigidity.

Moulds or shells of greater heights or depths require thicker plastic sheets for the vacuum forming method. The thicker plastic sheets can cause difficulty in removing the first shell 122 from the first mould 250 and trimming the periphery of the first shell 122 after the vacuum forming step. Additional considerations on tolerance of the dimensions in the first mould 250 are taken because a plastics sheet may shrink after the vacuum-forming step, which tend to result some inaccuracy of the dimensions.

Some other thermo-forming methods may be adopted as alternatives of the vacuum forming method. For example, a drape forming method can be used for making the first shell 122 for producing parts with detailed shapes, such as a corrugated joint. A splay molding method can further be adopted for fabricating parts with higher strength by using Fiber Reinforced Plastics. The splay molding method may take longer time for manufacturing a same part as compared that by the vacuum forming method.

The vacuum forming method is a heating-vacuum-cooling process that can adopts most types of thermoplastic materials. At least four types of thermoplastics can be accepted and are tested for producing the shells 122-136. The four types of thermoplastic materials consist of PC (Polycarbonate), PS (Polystyrene), PVC (Polyvinyl Chloride) and PLA (Poly Lactic Acid, Biodegradable plastic).

PC is relatively stiff and is suitable for architectural use. However, if a mould has a relatively complex shape, as compared to a simple dome structure (e.g. top-light component), PC may pose some difficulty in conforming to the shape of the mould because PC requires a long heating time, resulting in a bubbling effect. Due to the stiffness of PC, it is also difficult to trim the periphery of a molded component after the vacuum forming. Of all the four thermoplastics, PS is the most stretchable during the vacuum forming method. The ability to conform to a mold's shape (i.e. traceability) is excellent.

A molded shell of PC material can become brittle after cooling down especially when the molded shell is thin. Therefore, the PC shell may not be suitable when the PC shell is required to resist repeated bending and stretching action.

PVC is a material that provides good balance between stiffness and flexibility. PVC sheet can follow the shape of the mould tightly during the vacuum forming step at with a relatively low heating temperature. After cooling, a shell of PVC can maintain flexibility and the molded PVC shell can easily be removed from the mould. PVC components, such as the first shell 122 of PVC material can also resist frequent bending and stretching actions due to its softness: The PVC components can also be easily trimmed.

PLA is a biodegradable plastic made of biopolymer. PLA can degrade into soil at above 60° C. with certain humidity and microorganism. Material strength of PLA is between PS and PVC and PLA has enough traceability for a complex mould, but becomes relatively brittle after the thermoforming.

The vacuum forming method of step is a process to stretch a flat sheet material into 3-D shape. Because of this stretching action, a thickness of the sheet material can be reduced (deflected). The higher/depth the mould is, the thinner the sheet thickness becomes. Due to this deflection, the thickness of the sheet material after the vacuum forming can be difficult to gauge. One way to estimate a deflected thickness (i.e. thickness of the sheet material after the vacuum forming) is to use a square grid lined sheet. After the vacuum forming, deformation of square grid lines indicates how the plastic sheets are stretched, both in direction and in dimension.

FIG. 31 illustrates a vacuum forming stretch testing. FIG. 32 illustrates a stretched PLC sheet 321 by the vacuum forming. According to FIGS. 31 & 32, vertical surfaces of the vacuum formed PLC sheet are the ones most apparently stretched, up to 200%, which results only about 50% of the original thickness. However, most of those vertical surfaces, except the ones facing to the ground, are to be combined with adjacent module so that eventually the combined thickness will be double the half, which means close to the original thickness of the PLC sheet material 321.

By referring FE analysis stress contour of the modular shelter 50, some of the most critical stress concentration regions have at least 3 mm after the vacuum forming step for maintaining its strength. A process of finding an appropriate thickness and an aspect ratio for the modular shelter 50 is aided by the FE analyses. When wall thickness of the modular shelter 50 is increased from 2 mm to 3 mm, the capacities of the respective models all increase by a significant amount. All of them can resist a wind pressure of at least 1,000 Pa.

Components of the modular shelter 50 are assembled by adopting various methods, tools and techniques. The components of the modular shelter 50 are assembled for ensuring structural continuity of the modular shelter 50.

In practice, solvent and adhesive bonding methods of assembling are generally efficient way. However, the solvent and adhesive bonding methods of assembling prevent disassembling the assembled modular shelter 50 for reuse. Due to inaccuracy of vacuum formed components, the solvent and adhesive bonding methods sometimes cannot ensure satisfactory bonding conditions.

In contrast, mechanical bonding methods, such as bolting, can be appropriate for the purpose of dismantling the modular shelter 50 after use. However, the mechanical bonding methods can increase an overall assembly time of the modular shelter 50. The modular shelter 50 adopts the mechanical bonding methods and the shells 122-136 have corrugated surface joints. For example, the first serrated divider 144 and the second serrated divider 162 jointly provide a corrugated surface joint, which increases friction between the first shell 122 and the second shell 124 and reduces the number of bolt connections. The corrugated dividers 144, 162 are rapidly produced by the vacuum-forming method. Steel washers, screws and nuts are employed for the bolting.

The first shell 122 the second shell 124, the third shell 126, the fourth shell 128, the fifth shell 130 and the sixth shell 132 have hyperbolic paraboloid sidewalls 142, 160 of similar shape and sizes substantially. The seventh shell 134 and the eighth shell 136 also have the hyperbolic paraboloid sidewalls 176, 194 of similar shape and sizes substantially. The first to sixth shells 122-132 are stacked for transportation. The seventh shell and the eighth shell 134, 136 are further stacked for being compact.

In an assembling process, once the eight shells 122-136 are on site, the eight shells 122-136 are assembled on ground to form the first curved wall 52. The eight shells 122-136 are firmly interlocked by the first centre joint 82. The second curved wall 54, the third curved wall 56 and the fourth curved wall 58 (roof panel) are assembled in a manner that is similar to that of the first curved wall 52.

The first curved wall 52, the second curved wall 54 and the third curved wall 56 are erected and bolted with the base plate 60 to the ground prior to the roof installation (mounting the fourth curved wall 58). The assembled fourth curved wall 58 is hoisted and positioned by two to four people onto the other three walls 52, 54, 56 without involving machinery. The fourth curved wall 58, which has similar weight as any of the other three walls 52, 54, 56, is about 42 kilogram when using PLA sheets of 3 millimeters thickness. The eight corner joints 90-104 are installed to lock the four walls 52, 54, 56, 58 together. A structural assembly process of the modular shelter 50 takes about less than one day (eight hours) by two persons, excluding foundation and flooring.

In the present embodiment, the modular shelter 50 provides not only lower weight/volume ratio close to the Dome, but also adaptability by modular design and efficient space usage by cubic like shape. The cost/area ratio of the modular shelter 50 provides higher transportation efficiency by stacking identical components compactly. In addition, walls 52-58 of the modular shelter 50 can be biodegraded after its use without burdening the environment.

The modular shelter 50 provides a lightweight structure, which provides both large efficient space and structure usage. The shells 122-136 of the modular shelter 50 are rapidly producible by vacuum forming. The modular shelter 50 can withstand external pressures on any of the walls 52-58. The modular shelter 50 has a cubical structure that provides a large internal usable space, as compared those of other lightweight structures, such as the Tent and the Dome. The shells 122-136 are reproducible by vacuum forming. Structural stiffness and strength of the modular shelter 50 can be modified rapidly by adjusting profiles of the shells 122-136 and shapes of the peripheral ribs.

The shells 122-136 comprise mainly four types of geometries such that a number of moulds are reduced to be less than the number of the shells 122-136. According to a FE (Finite Element) structural simulation, the modular shelter 50 can resist wind pressure up to 1,040 Pa, which is sufficient for withstanding a typical typhoon. The Bio-Shell consists of vacuum-formed components, which are identical shapes, thus easy to stack in compact volume. This is ideal for efficient transportation. Eight shells 122-136 are assembled with corrugated friction joint with three bolts (with washers) per periphery to form each wall/roof panel on ground. The center joint 82 ensure structural continuity among eight shells 122-136. Three curved walls 52, 54, 56 are elected, then later the roof panel 58 is hoisted and sit on other wall panels 52, 54, 56. The top corner parts of wall panels 52, 54, 56 are covered by the roof corner part 58, in order to make it as waterproofing. Corner joints 90-104 fix the gaps between panels 52-58 at corners both in and outside. Bracing or wall frames 74-80 are employed and connected to the center and corner joints 82-88, 90-104 when extra strength is necessary for against typhoon. As all parts are connected by friction joints (bolts and corrugation), it is easy to disassemble. If the modular shelter 50 needs to be disposed on site, it biodegrades in ninety days without damaging environment. The overall assembly time of the modular shelter 50 is approximately eight hours for workers.

FIG. 33 illustrates the stacked shells 122-132, 134-136 and centre joints 82-88. The stacked parts of the first modular shelter 50 are compact for storage and transportation.

FIG. 34 relates to a second embodiment of the present application. The second embodiment contains parts that are similar to those of the first embodiment in FIGS. 1-20. The similar parts are labeled with reference numerals that are the same or similar to those of the first embodiment. Description of the similar parts is hereby incorporated by reference.

In particular, FIG. 34 illustrates another modular shelter 250 with three curved walls 52, 58, 56. The three curved walls 52, 58, 56 consist of a first curved wall 52, a fourth curved wall 58 and a third curved wall 56. Both the first curved wall 52 and the third curved wall 56 are fixed directly to the ground (not shown) such that the modular shelter 250 avoids using a base plate 60.

FIG. 35 relates to a third embodiment of the present application. The third embodiment contains parts that are similar to those of the other embodiments. The similar parts are labeled with reference numerals that are the same or similar to those of the other embodiments. Description of the similar parts is hereby incorporated by reference.

Specifically, FIG. 35 illustrates a further modular shelter 352 with five curved walls 52, 54, 56, 58, 254 respectively. A front entrance of the modular shelter 252 is covered by a fifth curved wall 254 that is hinged to the first curved wall 52 for closing and opening. The modular shelter 352 does not rely on its connection to the ground for upholding its structure.

FIG. 36 relates to a fourth embodiment of the present application. The fourth embodiment contains parts that are similar to those of the other embodiments. The similar parts are labeled with reference numerals that are the same or similar to those of the other embodiments. Description of the similar parts is hereby incorporated by reference.

Specifically, FIG. 36 illustrates a further modular shelter 356 with three curved walls 52, 258, 260 respectively. The three curved walls 52, 258, 260 consist of a first curved wall 52, a sixth curved wall 258 and a seventh curved wall 260. At a joint of the sixth curved wall 258 and a seventh curved wall 260, corners of the two curved walls 258, 260 are taken away such that the modular shelter 356 has a window 362 for ventilation. A rib 364 in a middle position of the window 362 pushes against both the two walls 358, 360 for keeping the two curved walls 358, 360 apart and holding a profile of the window 362.

FIG. 37 relates to a fifth embodiment of the present application. The fifth embodiment contains parts that are similar to those of the other embodiments. The similar parts are labeled with reference numerals that are the same or similar to those of the other embodiments. Description of the similar parts is hereby incorporated by reference.

Specifically, FIG. 37 illustrates a further modular shelter 366 with three curved walls 368, 370, 372. The three curved walls 368, 370, 372 consist of an eighth curved wall 368, a ninth curved wall 370 and a tenth curved wall 372 that are sequentially, connected. The three curved walls 368, 370, 372 have similar structures such that each of the walls 368, 370, 372 is formed by four square-profiled sub-walls. Each of the curved walls 368, 370, 372 has similar external dimensions (as large) as the first curved wall 52. In particular, the eighth curved wall 368 has a first sub-wall 374, a second sub-wall 376, a third sub-wall 378 and a fourth sub-wall 380. The four sub-walls 374, 376, 378, 380 have similar structures and each of the sub-walls 374, 376, 378, 380 has four sub-shells. For example, the first sub-wall 374 has a first sub-shell 382, a second sub-shell 384, a third sub-shell 386 and a fourth sub-shell 388. The first sub-shell 382 has structures that are similar to those of the first shell 122 and the second shell 124 combined. The second sub-shell 384 has structures that are similar to those of the third shell 126 and the fourth shell 128 combined. The third sub-shell 386 has structures that are similar to those of the fifth shell 130 and the sixth shell 132 combined, whilst the fourth sub-shell 388 has structures that are similar to those of the seventh shell 134 and the eighth shell 136 combined.

FIG. 38 relates to a sixth embodiment of the present application. The sixth embodiment contains parts that are similar to those of the other embodiments. The similar parts are labeled with reference numerals that are the same or similar to those of the other embodiments. Description of the similar parts is hereby incorporated by reference.

FIG. 38 illustrates a stacked modular shelter 390 with multiple modular shelters 392-402. The stacked modular shelter 390 consists of a first sub-shelter 392, a second sub-shelter 394, a third sub-shelter 396, a fourth sub-shelter 398, a fifth sub-shelter 400 and a sixth sub-shelter 402. The fourth sub-shelter 398, the fifth sub-shelter 400 and the sixth sub-shelter 402 are all laid on the ground and also connected next to each other side-by-side as a ground level shelter. The first sub-shelter 392 is put on top of the sixth sub-shelter 402; the second sub-shelter 394 is provided on top of the fifth modular shelter 400; whilst the third sub-shelter 396 lie on top of the fourth sub-shelter 398. In other words, the first sub-shelter 392, the second sub-shelter 394 and the third sub-shelter 396 are stacked on top of the three connected modular shelters 398, 400, 402 on the ground level. In other words, the stacked modular shelter 390 is a two story building that has two three rooms at each level. Each of the six modular shelters 392-402 has its front side opening towards a depth direction and each of the modular shelters 392-402 has its structures similar to the first embodiment of FIGS. 1-33. The stacked modular shelter 390 is also known as a W (Width) 3×D (Depth) 1×H (Height) 2 module. Accordingly, the stacked modular shelter 390 has a width of about 7400 mm, a depth of about 3000 mm and a height of 4800 mm.

FIG. 39 illustrates a semi-open shelter 404 with multiple modules elevated. The semi-open shelter 404 comprises three contiguous modular shelters 406, 408, 410 on a second floor and three other contiguous modular shelters 412, 414, 416 to form its first floor (ground level). The three modular shelters 406, 408, 410 on the second level include a seventh sub-shelter 406, an eighth sub-shelter 408 and a ninth sub-shelter 410 that are joined to each other sequentially. There is no partition wall between neighboring sub-shelters 406, 408, 410. Besides, none of these sub-shelters 406, 408, 410 has a floor. At the first floor, the three neighboring sub-shelters 412, 414, 416 have no partition wall in-between and these three adjoining sub-shelters 412, 414; 416 opens at two sides. The semi-open shelter 404 is suitable for providing an exhibition booth.

The semi-open shelter 404 supported by five pillars 418-426, which consists of a first pillar 418, a second pillar 420, a third pillar 422, a fourth pillar 424, a fifth pillar 426 and a sixth pillar 428 (not visible). The first pillar 418 is provided at a front corner of the tenth sub-shelter 312; the second pillar 320 is provided at a front joint-corner of the tenth sub-shelter 412 and the eleventh sub-shelter 414; the third pillar 422 is provided at a front joint-corner of the eleventh sub-shelter 414 and the twelfth sub-shelter 416; the fourth pillar 424 is provided at a front corner of the twelfth sub-shelter 416 and the fifth pillar 426 is provided at a back corner of the twelfth sub-shelter 416.

FIG. 40 illustrates an extended modular shelter 430 with a side entrance 432. The extended modular shelter 430 has five extended walls 434-440. The four extended walls 434-442 consist of a first extended wall 434, a second extended wall 436, a third extended wall 438, a fourth extended wall 440 and a fifth extended wall 442 that are adjoined to each other. The fifth extended wall 442 acts as a ceiling that is contiguous to the other four extended walls 434-440. The first extended wall 434, the second extended wall 436 and the third extended wall 438 have similar structures and sizes.

For example, the first extended wall 434 has four shells along its width and three shells along its height. However, the fifth extended wall 442 has four shells along its both width and length respectively. Each of these shells is similar to the first shell 122. Moreover, the fourth extended wall 440 is connected to the third extended wall 438, but disconnected to the first extended wall 434. The fourth extended wall 440 has a width of two shells and a height of three shells. Hence, the side entrance 434 has a width of two shells and a height of three shells. The extended modular shelter 430 is also known as a W (Width) 2×D (Depth) 2×H (Height) 1.5 module. Accordingly, the extended modular shelter 428 has a width of about 5200 mm, a depth of about 5200 mm and a height of 3700 mm.

The choice between single module, 50, 352, 356, 366 and multiple module shelters 390, 404, 430 is influenced by two competing factors: performance (load-carrying capacity) and cost. With the same overall dimensions and aspect ratio, multiple modules models give lower wind load resistance, but they are cheaper than single module models because the size of moulds required for multiple modules is about one quarter. Given the same overall model size and modular component size, the model with lower aspect ratio a/h can resist a larger wind load. The goal is to choose a cost-effective structure. While the load-carrying capacity of single module model with aspect ratio 1:4 and multiple modules model with aspect ratio of 1:2.8 are about the same, the multiple module option is cheaper.

In the application, unless specified otherwise, the terms "comprising", "comprise", and grammatical variants thereof, intended to represent "open" or "inclusive" language such that they include recited elements but also permit inclusion of additional, non-explicitly recited elements.

As used herein, the term "about", in the context of concentrations of components of the formulations, typically means +/−5% of the stated value, more typically +/−4% of the stated value, more typically +/−3% of the stated value, more typically, +/−2% of the stated value, even more typically +/−1% of the stated value, and even more typically +/−0.5% of the stated value.

Throughout this disclosure, certain embodiments may be disclosed in a range format. The description in range format is merely for convenience and brevity and should not be construed as an inflexible limitation on the scope of the disclosed ranges. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

It will be apparent that various other modifications and adaptations of the application will be apparent to the person skilled in the art after reading the foregoing disclosure without departing from the spirit and scope of the application and it is intended that all such modifications and adaptations come within the scope of the appended claims.

REFERENCE NUMERALS

50 first modular shelter
52 first curved wall
54 second curved wall
56 third curved wall
58 fourth curved wall
59 front side
60 base plate
61 interior
62 width
64 height
66 left width
68 right width
69 upper height
70 left corner width
71 lower height
72 right corner width
73 top corner width
74 first wall frame
76 second wall frame
78 third wall frame
80 fourth wall frame
82 first centre joint
84 second centre joint
86 third centre joint
88 fourth centre joint
89 corner
90 first corner joint
92 second corner joint
94 third corner joint
96 fourth corner joint
98 fifth corner joint
100 sixth corner joint
102 seventh corner joint
104 eighth corner joint
106 first bar
107 second bar
108 third bar
109 fourth bar
110 fifth bar
111 sixth bar
112 seventh bar
113 eighth bar
114 ninth bar
115 tenth bar
116 eleventh bar
117 twelfth bar
118 thirteenth bar
119 fourteenth bar
120 fifteenth bar
121 sixteenth bar
122 first shell
124 second shell
126 third shell
128 fourth shell
130 fifth shell
132 sixth shell
134 seventh shell
136 eighth shell

138 first corner extension
140 first serrated slope
142 first hyperbolic paraboloid sidewall
143 shell
144 first serrated divider
145 first shell edge
146 wall plane
147 pocket
148 first gutter
149 edge
150 second gutter
151 second shell edge
152 first side
154 second side
155 pocket
156 second corner extension
157 edge
158 second serrated slope
160 second hyperbolic paraboloid sidewall
162 second serrated divider
164 second tongue
166 third tongue
168 third side
170 fourth tongue
174 first serrated base
176 third hyperbolic paraboloid sidewall
178 third serrated divider
180 first tongue
181 pocket
182 fourth side
183 edge
184 fifth side
185 edge
186 third gutter
188 fourth gutter
189 pocket
190 sixth side
191 edge
192 second serrated base
193 edge
194 fourth hyperbolic paraboloid sidewall
195 pocket
196 fourth serrated divider
198 sixth side
202 first outer plate
203 corrugated friction joint
204 first bolt
205 wall
206 first nut
207 wall
208 first inner plate
209 synthetic plastic mould
210 first peripheral
212 first screw set
214 second screw set
216 third screw set
218 fourth screw set
220 thickness
222 inner corner piece
224 outer corner piece
226 central bowl-shaped pocket
228 corner screw
230 corner washer
232 corner nut
234 first rib
235 second rib
236 third rib
237 fourth rib
238 fifth rib
240 central recess
241 sixth rib
242 seventh rib
243 conduit
244 eighth rib
245 fastener
246 screw
248 bar
250 first mould
252 first board component
254 first shell component
256 first corner component
258 first gutter component
260 second gutter component
262 first serrated side
264 second mould
266 second board component
268 second shell component
270 second corner component
272 second serrated side
274 third mould
276 third board component
278 third shell component
280 third gutter component
282 fourth gutter component
284 third serrated side
286 fourth serrated side
288 fourth mould
290 fourth board component
292 fourth shell component
294 fifth serrated side
296 sixth serrated side
298 length of the first shell component
300 width of the first shell component
302 height of the first shell component
304 length of the first corner component
306 width of the first corner component
308 height of the first corner component
310 length of the second shell component
312 width of the second shell component
314 height of the second shell component
318 length of the second corner component
320 width of the second corner component
321 sheet material
322 height of the second corner component
324 hyperbolic paraboloid surface
326 three-dimensional Cartesian coordinate
328 X-axis
330 Y-axis
332 Z-axis
350 modular shelter
352 modular shelter
354 fifth curved wall
356 modular shelter
358 sixth curved wall
360 seventh curved wall
362 window
364 rib
366 modular shelter
368 eighth curved wall
370 ninth curved wall
372 tenth curved wall
374 first sub-wall
376 second sub-wall
378 third sub-wall

380 fourth sub-wall
382 first sub-shell
384 second sub-shell
386 third sub-shell
388 fourth sub-shell
390 stacked modular shelter
392 first sub-shelter
394 second sub-shelter
396 third sub-shelter
398 fourth sub-shelter
400 fifth sub-shelter
402 sixth sub-shelter
404 semi-open shelter
406 seventh sub-shelter
408 eighth sub-shelter
410 ninth sub-shelter
412 tenth sub-shelter
414 eleventh sub-shelter
416 twelfth sub-shelter
418 first pillar
420 second pillar
422 third pillar
424 fourth pillar
426 fifth pillar
428 sixth pillar
430 extended modular shelter
432 side entrance
434 first extended wall
436 second extended wall
438 third extended wall
440 fourth extended wall
442 fifth extended wall

The invention claimed is:

1. A first modular shelter (50) comprising:

a first curved wall (52) that further comprises a first shell (122) and a second shell (124), wherein the first shell (122) comprises a first curved base wall (142) and a first sidewall (144), the first sidewall (144) extending from a first shell edge (145) of the first curved base wall (42) for supporting the first curved base wall (142), and the second shell (124) comprises a second curved base wall (160) and a second sidewall (162), the second sidewall (162) extending from a second shell edge (151) of the second curved base wall (160) for supporting the second curved base wall (162);

wherein the first sidewall (144) has a first corrugated region and the second side wall (162) has a second corrugated region which matches the first corrugated region; and wherein the mating of the first corrugated region with the second corrugated region forms a rib (235) for connecting the first shell (122) to the second shell (124) and for increasing friction between the first shell (122) and the second shell (124);

wherein the first shell (122) comprises a first extension wall (138, 140) that extends from another edge (149) of the first curved base wall, and the second shell having a second extension wall being connected to the first extension wall for joining the first shell to the second shell to form a corner wall of the first modular shelter.

2. The first modular shelter (50) of claim 1, wherein the first sidewall (144) and the first curved base wall (142) form a first pocket (147) for receiving the second shell (124).

3. The first modular shelter (50) of claim 2, wherein the first shell (122) and the second shell (124) have shapes adapted such that the second shell (124) is receivable by the first pocket (147) for stacking.

4. The first modular shelter (50) of claim 2, wherein the first extension wall (138, 140) comprises a corrugated region (140).

5. The first modular shelter (50) of claim 4, wherein the first sidewall (144), the first curved base wall (142) and the first extension wall (138, 140) form the first pocket (147) for receiving the second shell (124).

6. The first modular shelter (50) of claim 5, wherein the first extension wall (138, 140, 174, 192) is substantially perpendicular to the first curved base wall (142, 160, 176, 194) for resting on a base plate (60).

7. The first modular shelter (50) of claim 1, wherein the first sidewall (144) comprises a gutter (150) and the second sidewall (162) comprises a tongue (164) for inserting into the gutter (150).

8. The first modular shelter (50) of claim 7 further comprising a second curved wall (54, 56, 58).

9. The first modular shelter (50) of claim 8, wherein another gutter (243) on the second curved wall (58) is connected to the gutter (50150) of the first curved wall (52) for drainage.

10. The first modular shelter (50) of claim 9 further comprising a conduit (243) that connects the gutter (150) of the first curved wall (52) to the other gutter of the second curved wall (58) for preventing water from entering an interior (61) of the first modular shelter (50).

11. The first modular shelter (50) of claim 8, further comprising a wall frame that comprises a corner joint (90, 92, 94, 96, 98, 100, 102, 104) for connecting corners (89) of neighboring curved walls (52, 54, 56, 58).

12. The first modular shelter (50) of claim 11 further comprising a third curved wall (56) and a fourth curved wall (58) that are connected to the first curved wall (52) and to the second curved wall (54) for forming an enclosure (61).

13. The first modular shelter (50) of claim 12 further comprising a base plate (60) that is connected and secured to the first curved wall (52).

14. The first modular shelter (50) of claim 13, wherein the base plate (60) further comprises a channel that is connected to at least one of the gutters (148, 150, 186, 188, 243) for draining water away from the first modular shelter (50).

15. The first modular shelter (50) of claim 13, wherein the first curved wall (52), the second curved wall (54) and the third curved wall (56) are connected for forming lateral sides of the first modular shelter (50), the fourth curved sidewall (58) resides on tops of the other three curved walls (52, 54, 56) for providing a roof (58), and the base plate (60) is further provided at bottoms of the first curved wall (52), the second curved wall (54) and the third curved wall (56) at an opposite side of the fourth curved wall (58) for forming the enclosure (61) with an opening side (59).

16. The first modular shelter (50) of claim 15, wherein the shells (122, 124, 126, 128, 30, 30, 134, 136) of at least one of the curved wall (52, 54, 56, 58) are connected together by a centre joint (82, 84, 86, 88), and at least two of the shells (122, 124, 126, 128, 130, 130, 134, 136) are joined together by the wall frame (74, 76, 78, 80).

17. The first modular shelter (50) of claim 1, wherein the first curved base wall (142) comprises a two-directional curvature.

18. The first modular shelter (50) of claim 1, wherein the first curved base wall (142) comprises a hyperbolic paraboloid curvature.

19. The first modular shelter (50) of claim 1, wherein the first curved wall (52) further comprises a centre joint (82, 84, 86, 88) for joining the first shell (122) and the second shell (124) together.

20. The first modular shelter (50) of claim 1, wherein the first curved wall (52) further comprises a wall frame (74, 76, 78, 80) that is connected to the first shell (22) and the second shell (124).

21. The first modular shelter (50) of claim 1 further comprising a pillar (418, 420, 422, 424, 426, 428) that is connected to the first curved wall (52) for elevating the first modular shelter (50) off the ground.

22. The first modular shelter (50) of claim 21, wherein the pillar (418, 420, 422, 424, 426, 428) comprises a shell (418, 420, 422, 424, 426, 428).

23. The first modular shelter (50) of claim 21, wherein the shell (418, 420, 422, 424, 426, 428) is stackable.

24. The first modular shelter (50) of claim 1, wherein the first shell (122) comprises a biodegradable material.

25. The first modular shelter (50) of claim 1 further comprising a fastener (245) for joining the first sidewall (144) and the second sidewall (162) in forming the rib (235).

26. The first modular shelter (50) of claim 1, wherein at least a portion of the first shell (22) is opaque or semitransparent.

27. A kit of parts for constructing the first modular shelter (50) according to claim 1, the kit of parts comprising:

a first shell (122) for providing a first curved wall (52) of the first modular shelter (50), and a second shell (124);

wherein the first shell (122) comprises a first curved base wall (142) and a first sidewall (144) for facing and connecting to a second side wall (162) of the second shell (124) in forming a rib (235), the first sidewall (144) extending from a first shell edge (145) of the first curved, base wall (142) for supporting the first curved base wall (142); and wherein the first shell comprises a first extension wall, and the second shell comprising a second extension wall for connecting to the first extension wall in forming a corner wall of the first modular shelter.

28. Method for making a first modular shelter (50) comprising:

providing a mould (250) and a sheet material (321);

forming a first shell (122) and a second shell (124), the first shell (122) comprising a first curved base wall (142) and a first sidewall (144) and the first sidewall (144) extending from a first shell edge (145) of the first curved base wall (142), the second shell (124) comprising a second curved base wall (160) and a second sidewall (162), the second sidewall (162) extending from a second shell edge (151) of the second curved base wall (160) for supporting the second curved base wall (162); and forming corrugations on the first sidewall (144), forming corrugations on the second sidewall (162) which matches the corrugations on the first sidewall (144), such that in operation, the mating of the corrugations of the first sidewall (144) and the corrugations of the second sidewall (162) forms a rib (235) for connecting the first shell (122) to the second shell (124) and for increasing friction between the first shell (122) and the second shell (124);

forming a first extension wall that extends from a further edge of the first shell, and a second extension wall that extends from a further edge of the second shell, such that in operation, the first and second extension walls being connected together in forming a corner wall of the first modular shelter.

29. Method of claim 28 further comprising bending a portion (148, 150) of the first shell in forming a gutter (148, 150, 243) and forming another portion (162) of another shell (124) in from a tongue (166) for inserting into the gutter (148).

* * * * *